US010625126B2

(12) United States Patent
Demkowski et al.

(10) Patent No.: US 10,625,126 B2
(45) Date of Patent: Apr. 21, 2020

(54) GOLF CLUB HEAD

(71) Applicant: Taylor Made Golf Company, Inc, Carlsbad, CA (US)

(72) Inventors: Paul M. Demkowski, San Diego, CA (US); Bret H. Wahl, Escondido, CA (US); Scott Taylor, Bonita, CA (US); Sanjay Kuttappa, Oceanside, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

(21) Appl. No.: 15/706,632

(22) Filed: Sep. 15, 2017

(65) Prior Publication Data

US 2018/0185717 A1 Jul. 5, 2018

Related U.S. Application Data

(63) Continuation-in-part of application No. 15/394,549, filed on Dec. 29, 2016.

(51) Int. Cl.
*A63B 53/04* (2015.01)
*A63B 60/54* (2015.01)

(52) U.S. Cl.
CPC ..... *A63B 53/047* (2013.01); *A63B 53/0466* (2013.01); *A63B 53/0475* (2013.01); *A63B 60/54* (2015.10); *A63B 2053/0412* (2013.01); *A63B 2053/0433* (2013.01); *A63B 2053/0462* (2013.01)

(58) Field of Classification Search
CPC ... A63B 53/0475; A63B 53/047; A63B 60/54; A63B 2053/0433; A63B 2053/0462; A63B 2053/0412; A63B 53/0466
See application file for complete search history.

(56) References Cited

U.S. PATENT DOCUMENTS 3,660,216 A * 5/1972 Theodorson ..... B32B 27/00 40/615
4,180,269 A * 12/1979 Thompson ..... A63B 53/04 473/336
5,178,392 A * 1/1993 Santioni ..... A63B 53/04 273/153 R
5,184,823 A * 2/1993 Desboilles ..... A63B 53/04 473/345
5,290,036 A * 3/1994 Fenton ..... A63B 53/04 473/332

(Continued)

OTHER PUBLICATIONS

United States Golf Associate and R&A Rules Limited, Interim Procedure for Measuring the Coefficient of Restitution of an Iron Clubhead Relative to a Baseline Plate; Revision 1.2, Nov. 30, 2005, pp. 1-6.

*Primary Examiner* — Stephen L Blau
(74) *Attorney, Agent, or Firm* — Kunzler Bean & Adamson

(57) ABSTRACT

Described herein is a golf club head that comprises a body and a strike plate. The body comprises a heel portion, a sole portion, a toe portion, and a top portion. The strike plate comprises an outer peripheral edge and at least a portion of a strike face. Furthermore, the strike plate is welded to the body via a peripheral weld between the outer peripheral edge of the strike plate and the body. The outer peripheral edge of the strike plate comprises at least one welded portion, welded to the body via the peripheral weld, and at least one non-welded portion, not welded to the body.

25 Claims, 22 Drawing Sheets

(56) References Cited

U.S. PATENT DOCUMENTS 5,447,311 A * 9/1995 Viollaz ..... A63B 53/04 473/342
6,811,496 B2 11/2004 Wahl et al.
7,121,958 B2 * 10/2006 Cheng ..... A63B 53/047 473/345
7,281,991 B2 * 10/2007 Gilbert ..... A63B 53/0466 473/342
8,012,040 B2 * 9/2011 Takechi ..... A63B 53/047 473/329
8,088,025 B2 * 1/2012 Wahl ..... A63B 53/047 473/346
8,210,965 B2 * 7/2012 Roach ..... A63B 53/047 473/329
8,353,785 B2 1/2013 Ines et al.
8,353,786 B2 1/2013 Beach et al.
9,044,653 B2 * 6/2015 Wahl ..... A63B 53/0475
9,199,143 B1 * 12/2015 Parsons ..... A63B 53/0475
9,492,722 B2 11/2016 Taylor et al.
9,808,685 B1 * 11/2017 Westrum ..... A63B 53/047
2005/0124437 A1 * 6/2005 Imamoto ..... A63B 53/04 473/346
2006/0252575 A1 * 11/2006 Chen ..... A63B 53/04 473/342
2010/0035017 A1 * 2/2010 Green ..... B29C 70/521 428/114
2011/0028240 A1 2/2011 Wahl et al.
2011/0275451 A1 11/2011 Chao et al.
2013/0252754 A1 * 9/2013 Bazzel ..... A63B 53/047 473/290
2013/0281227 A1 * 10/2013 Roach ..... A63B 53/0475 473/332
2013/0331201 A1 * 12/2013 Wahl ..... A63B 53/0475 473/329
2014/0274456 A1 * 9/2014 Cardani ..... A63B 53/047 473/335
2015/0133232 A1 5/2015 Taylor et al.
2015/0328504 A1 * 11/2015 Finn ..... A63B 53/047 473/324
2015/0375065 A1 12/2015 Beach et al.
2016/0038796 A1 2/2016 Taylor et al.
2016/0193508 A1 7/2016 Issertell et al.
2016/0287952 A1 10/2016 James et al.
2018/0028883 A1 2/2018 Morin et al.
2018/0185715 A1 7/2018 Demkowski et al.

* cited by examiner

GOLF CLUB HEAD

CROSS-REFERENCE TO RELATED APPLICATIONS

This application references U.S. Pat. No. 9,044,653, filed Mar. 14, 2013, which claims the benefit of U.S. Provisional Patent Application No. 61/657,675, filed Jun. 8, 2012, both of which are hereby incorporated by reference herein in their entireties. This application also references U.S. Pat. No. 8,353,785, filed Apr. 19, 2010, which claims the benefit of U.S. Provisional Patent Application No. 61/214,487, filed Apr. 23, 2009, both of which are hereby incorporated by reference herein in their entireties. This application also references U.S. Pat. No. 6,811,496, filed Sep. 3, 2002, which is hereby incorporated by reference in its entirety. This application also references U.S. patent application Ser. No. 13/111,715, filed May 19, 2011, which is incorporated herein by reference in its entirety. This application further references U.S. patent application Ser. No. 14/981,330, filed Dec. 28, 2015, which claims the benefit of U.S. Provisional Patent Application No. 62/099,012, filed Dec. 31, 2014, and U.S. Provisional Patent Application No. 62/098,707, filed Dec. 31, 2014, all of which are incorporated herein by reference in their entirety.

FIELD

This disclosure relates generally to golf clubs, and more particularly to a golf club head with a strike plate that is separately attached to a body of the golf club head.

BACKGROUND

The performance of golf equipment is continuously advancing due to the development of innovative clubs and club designs. While all clubs in a golfer's bag are important, both scratch and novice golfers rely on the performance and feel of their irons, metal-woods, hybrids, and drivers for many commonly encountered playing situations.

Advancements in golf club head manufacturing techniques have facilitated the manufacturing of golf club heads with complex geometries. For example, separately forming and attaching together a strike plate and a body, a golf club head with a complex geometry, that might not otherwise be achievable using single-piece, fully-integrated manufacturing techniques, can be produced. Additionally, a golf club head with a separately formed and attached strike plate can facilitate the use of strike plates and bodies made from different materials and/or manufacturing techniques. Generally, the strike plate is welded to the body using a peripheral weld that extends continuously around the entire outer peripheral edge of the strike plate.

Although welding the strike plate to the body promotes the ability to make golf club heads with complex geometries, different materials, and different manufacturing techniques, the weld may also introduce weaknesses to the golf club head.

SUMMARY

The subject matter of the present application has been developed in response to the present state of the art, and in particular, in response to the shortcomings of golf clubs and associated golf club heads, that have not yet been fully solved by currently available techniques. Accordingly, the subject matter of the present application has been developed to provide a golf club and golf club head that overcome at least some of the above-discussed shortcomings of prior art techniques.

Described herein is a golf club head that comprises a body. The body comprises a heel portion, a sole portion, a toe portion, and a top portion, a filler material, and an internal cavity is configured to receive the filler material. A first COR drop off value when the internal cavity is unfilled. A second COR drop off value when the internal cavity is filled. a COR change value being a difference between the second COR drop off value and the first COR drop off value. The COR change value is between 0 and −0.1. The preceding subject matter of this paragraph characterizes example 1 of the present disclosure.

The COR change value is between 0 and −0.05. The preceding subject matter of this paragraph characterizes example 2 of the present disclosure, wherein example 2 also includes the subject matter according to example 1, above.

The first COR drop off value is between 0 and −0.05. The preceding subject matter of this paragraph characterizes example 3 of the present disclosure, wherein example 3 also includes the subject matter according to example 2, above.

The second COR drop off value is between 0 and −0.05. The preceding subject matter of this paragraph characterizes example 4 of the present disclosure, wherein example 4 also includes the subject matter according to example 3, above.

The filler material is a two part polyurethane foam. The preceding subject matter of this paragraph characterizes example 5 of the present disclosure, wherein example 5 also includes the subject matter according to any one of examples 1-4, above.

The filler material is a thermoset. The preceding subject matter of this paragraph characterizes example 6 of the present disclosure, wherein example 6 also includes the subject matter according to any one of examples 1-4, above.

The filler material is a methylene diphenyl diisocyanate. The preceding subject matter of this paragraph characterizes example 7 of the present disclosure, wherein example 7 also includes the subject matter according to any one of examples 1-4, above.

The filler material is flexible after it is cured. The preceding subject matter of this paragraph characterizes example 8 of the present disclosure, wherein example 8 also includes the subject matter according to any one of examples 1-4, above.

The outer peripheral edge of the strike plate further comprises a plurality of welded portions and a plurality of non-welded portions. The plurality of welded portions are spaced apart from each other by the plurality of non-welded portions. The preceding subject matter of this paragraph characterizes example 9 of the present disclosure, wherein example 9 also includes the subject matter according to example 1, above.

Further described herein is a golf club set, comprising at least one golf club head having a body. The body further comprises a heel portion, a sole portion, a toe portion, and a top portion, a filler material, and an internal cavity, the internal cavity is configured to receive the filler material. A first COR drop off value when the internal cavity is unfilled. A second COR drop off value when the internal cavity is filled. A COR change value being a difference between the second COR drop off value and the first COR drop off value. The COR change value is between 0 and −0.1. The preceding subject matter of this paragraph characterizes example 10 of the present disclosure.

At least two golf club heads within the golf club set have a COR change value between 0 and −0.1. The preceding subject matter of this paragraph characterizes example 11 of the present disclosure, wherein example 11 also includes the subject matter according to example 10, above.

An average COR change value of at least two golf club heads is between 0 and −0.1. The preceding subject matter of this paragraph characterizes example 12 of the present disclosure, wherein example 12 also includes the subject matter according to example 10, above.

The first COR drop off value is between 0 and −0.05 for the at least two golf club heads. The preceding subject matter of this paragraph characterizes example 13 of the present disclosure, wherein example 13 also includes the subject matter according to example 12, above.

The second COR drop off value is between 0 and −0.05 for the at least two golf club heads. The preceding subject matter of this paragraph characterizes example 14 of the present disclosure, wherein example 14 also includes the subject matter according to example 13, above.

Additionally described herein is a golf club head comprising a body. The body further comprises a heel portion, a sole portion, a toe portion, and a top portion, at least one filler material, at least one port, and an internal cavity, the internal cavity is configured to receive the at least one filler material through the at least one port. A first COR drop off value when the internal cavity is unfilled. A second COR drop off value when the internal cavity is filled. A COR change value being a difference between the second COR drop off value and the first COR drop off value. The COR change value is greater than −0.1. The preceding subject matter of this paragraph characterizes example 15 of the present disclosure.

A plug at least partially covers the port. The preceding subject matter of this paragraph characterizes example 16 of the present disclosure, wherein example 16 also includes the subject matter according to example 15, above.

The COR change value is greater than −0.05. The preceding subject matter of this paragraph characterizes example 17 of the present disclosure, wherein example 17 also includes the subject matter according to example 15, above.

The first COR drop off value is between 0 and −0.05. The preceding subject matter of this paragraph characterizes example 18 of the present disclosure, wherein example 18 also includes the subject matter according to example 17, above.

The second COR drop off value is between 0 and −0.05. The preceding subject matter of this paragraph characterizes example 19 of the present disclosure, wherein example 19 also includes the subject matter according to example 8, above.

The at least one filler material is a thermoset. The preceding subject matter of this paragraph characterizes example 20 of the present disclosure, wherein example 20 also includes the subject matter according to example 19, above.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

The following describes embodiments of golf club heads in the context of an iron-type golf club and a metal-wood-type golf club, but the principles, methods and designs described may be applicable in whole or in part to utility golf clubs (also known as hybrid golf clubs), driver-type golf clubs, putter-type golf clubs, and the like.

The various embodiments of a golf club head described herein utilizes a peripheral weld to secure a strike plate to a body of the golf club head. Welding the strike plate to the body of the golf club head, as opposed to integrally forming the strike plate and the body as a one-piece construction (such as by casting) allows the strike plate to be made from a different material or made by a different manufacturing process than the body. Additionally, welding the strike plate to the body promotes the ability to make golf club head with unique and complex shapes and geometries. However, welding together the strike plate and the body also introduces certain consequences, such as the development of heat effected zones and stress risers in the weld, which ultimately weakens the golf club head, and stiffness of the strike face of the golf club head. The peripheral weld of the golf club head disclosed herein introduces portions of the outer peripheral edge of the strike plate that are not welded to the body, thereby increasing the strength of the golf club head compared to golf club heads with continuous or 360-degree welds welding the strike plate to the body. Additionally, introducing non-welded portions of the outer peripheral edge of the strike plate also promotes flex in the strike face of the golf club head, which promotes forgiveness and feel.

The discovered advantages of introducing non-welded portions in the outer peripheral edge of the strike plate outweigh the potential negative consequences of such non-welded portions that would otherwise discourage the use of non-welded portions in the outer peripheral edge. For example, non-welded portions in an outer peripheral edge of a strike plate may increase the potential for rust at the non-welded portions and stress risers at the intersection of non-welded and welded portions of the outer peripheral edge. As another example, the chrome plating often used to plate a golf club head may crack or phantom lines may develop at the non-welded portions. Notwithstanding the potential disadvantages of introducing non-welded portions of a strike plate, the ability to reduce stress risers along the non-welded portions and promote the flex of the strike face through the use of non-welded portions, as discovered by the inventors of the present disclosure, encourages the use of non-welded portions in the outer peripheral edge of a strike plate.

Figure 1:
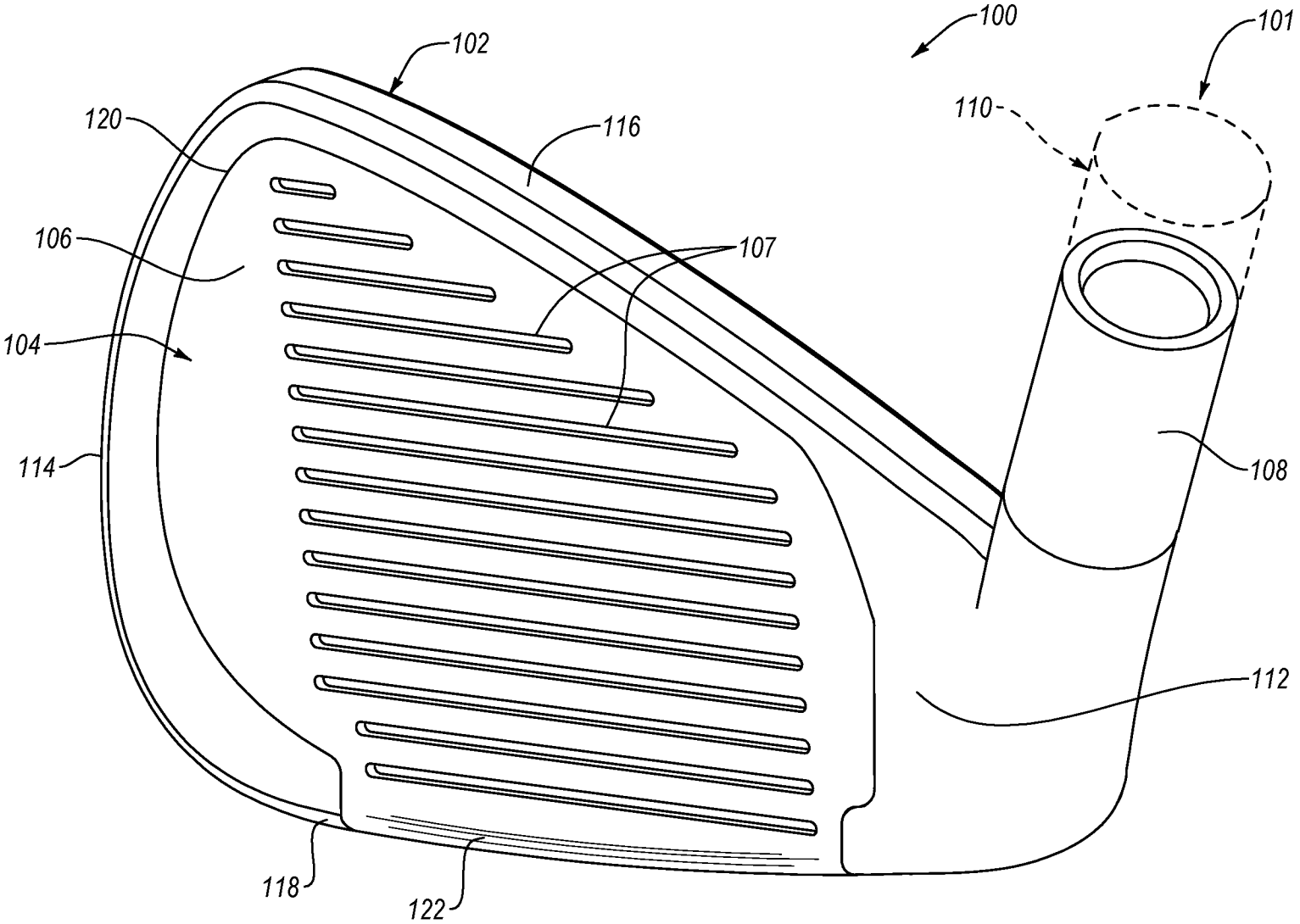
FIG. 1 is a perspective view from a top of an iron-type golf club head, according to one or more examples of the present disclosure.
Figure 2:
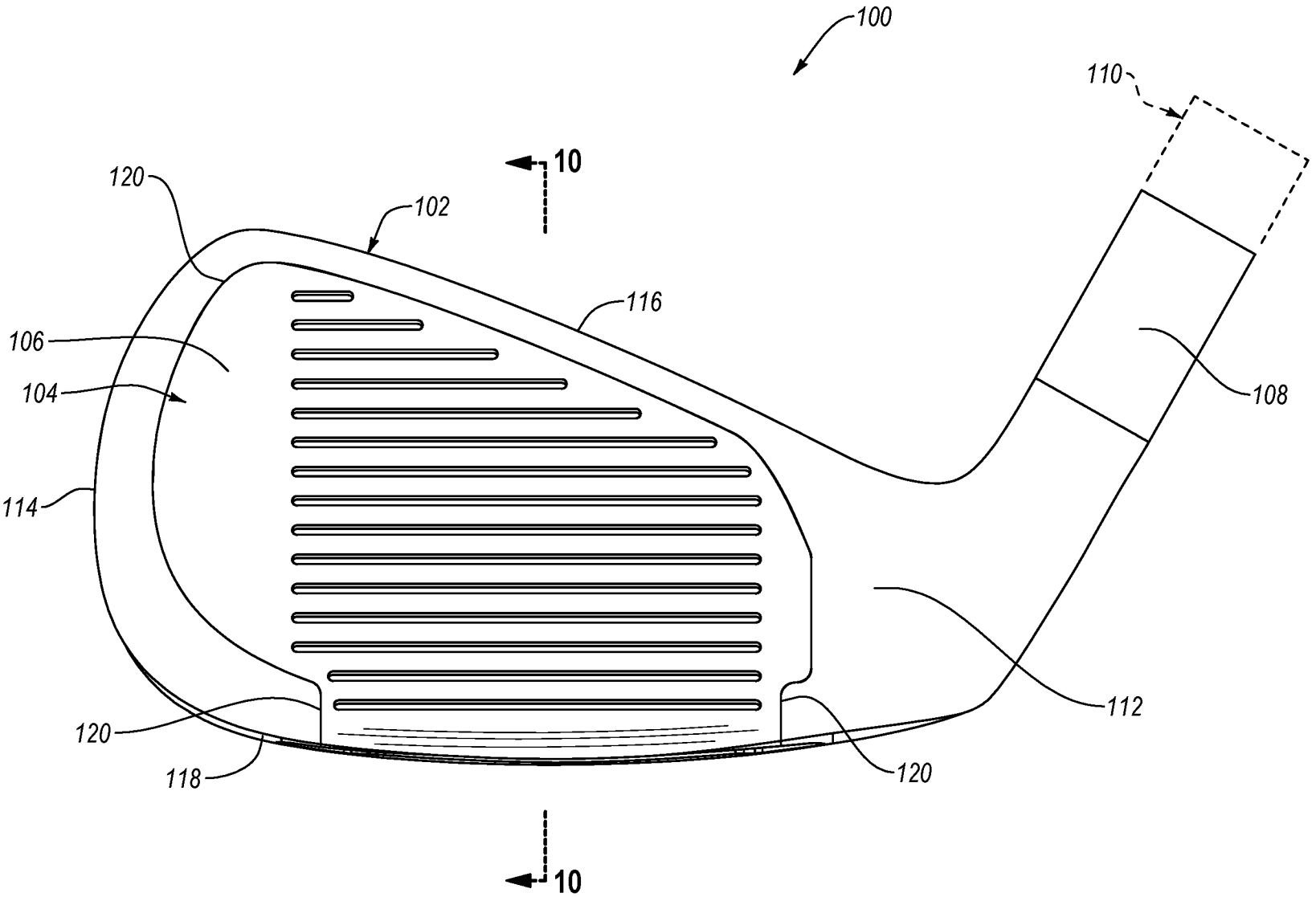
FIG. 2 is a front view of the golf club head of FIG. 1, according to one or more examples of the present disclosure.

Referring to FIGS. 1 and 2, one embodiment of a golf club head 100 includes a body 102 and a strike plate 104 welded to the body 102. The body 102 has a toe portion 114, a heel portion 112, a top portion 116 (e.g., top-line portion for iron-type golf club heads and crown portion for driver-type, hybrid-type, and metal-wood-type golf club heads), and a sole portion 118 (e.g., bottom portion). The body 102 additionally includes a hosel 108 extending from the heel portion 112. The hosel 108 is configured to receive and engage with a shaft and grip 110 of a golf club 101. The shaft extends from the hosel 108 and the grip is secured to the shaft at a location on the shaft opposite that of the golf club head 100. The strike plate 104 includes at least a portion of a strike face 106 designed to impact a golf ball during a normal golf swing. In some implementations, the strike plate 104 includes an entirety of the strike face 106. Generally, the strike plate 104 is defined as any piece of the golf club head 100 that is welded to a body 102 of the golf club head 100 and includes at least a portion of the strike face.

Generally, for many iron-type golf club heads, such as the golf club head 100, the strike face 106 has a planar surface that is angled relative to a ground plane when the golf club head 100 is in an address position to define a loft of the golf club head 100. In other words, the strike face 106 of an iron-type golf club head generally does not include a curved surface. Accordingly, the strike face 106 of the strike plate 104 of the iron-type golf club head 100 is defined as the portion of the strike face 106 with an outwardly facing planar surface. In other words, although a strike plate 104 may include a curved surface, such as an outer surface of a sole wrap portion 122 of the strike plate 104, the strike face 106 does not include such a curved surface. In contrast, the strike face of a metal-wood, driver, or hybrid golf club head does have a curved surface that curves around a substantially upright axis. Because the sole wrap portion 122 wraps around a substantially horizontal axis, the strike face of the strike plate of the metal-wood, driver, and hybrid golf club head is defined as the portion of the strike face 106 with an outwardly facing surface curved about an upright axis, as opposed to a horizontal axis.

The strike plate 104 further includes grooves 107 formed in the strike face 106 to promote desirable flight characteristics (e.g., backspin) of the golf ball upon being impacted by the strike face 106.

Figure 5:
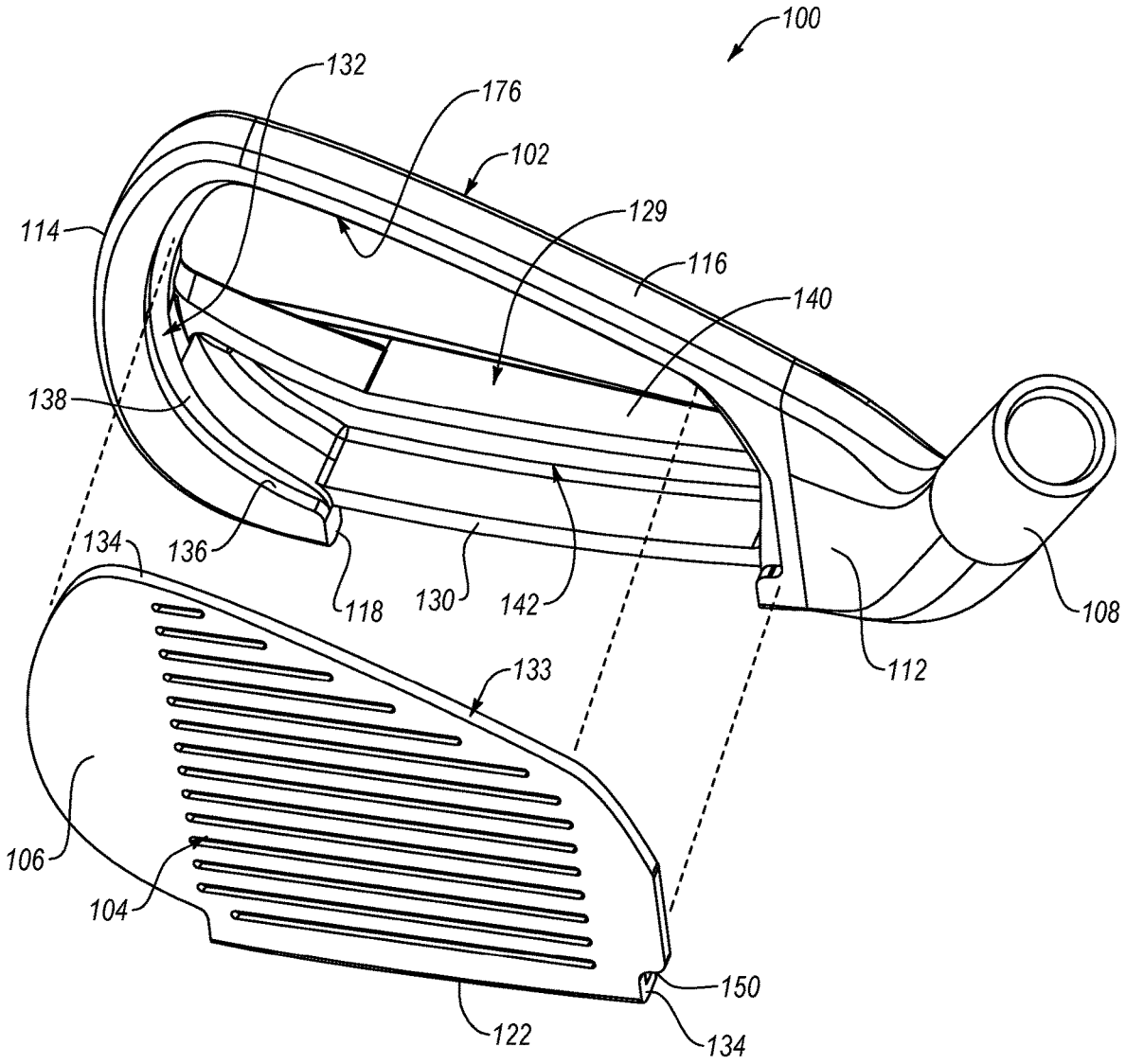
FIG. 5 is an exploded perspective view from a top of the golf club head of FIG. 1, according to one or more examples of the present disclosure.

Referring to FIG. 5, the strike plate 104 is formed separately from the body 102 and is separately attached to the body 102. The body 102 and the strike plate 104 can be formed using the same type of process or different types of processes. In the illustrated embodiment, the body 102 is formed to have a one-piece monolithic construction using a first manufacturing process and the strike plate 104 is formed to have a separate one-piece monolithic construction using a second manufacturing process. However, in other embodiments, one or both of the body 102 and the strike plate 104 has a multiple-piece construction with each piece being made from the same or a different material. Additionally, the body 102 can be formed of the same material as or a different material than the strike plate 104. The body 102 is made from a first material and the strike plate 104 is made from a second material. Separately forming and attaching together the body 102 and the strike plate 104 and making the body 102 and the strike plate 104 from the same or different materials, which allows flexibility in the types of manufacturing processes and materials used, promotes the ability to make a golf club head 100 that achieves a wide range of performance, aesthetic, and economic results.

In some implementations, the first manufacturing process is the same type of process as the second manufacturing process. For example, both the first and second manufacturing processes are casting processes in one implementation. As another example, both the first and second manufacturing processes are forging processes in one implementation. According to yet another example, both the first and second manufacturing processes are machining processes in one implementation.

However, in some other implementations, the first manufacturing process is a different type of process than the second manufacturing process. The first manufacturing process is one of a casting process, a machining process, and a forging process and the second manufacturing process is another of a casting process, a machining process, and a forging process in some examples. In one particular example, the first manufacturing process is a casting process and the second manufacturing process is a forging process. The first manufacturing process and/or the second manufacturing process can be a process as described in U.S. Pat. No. 9,044,653, which is incorporated herein in its entirety, such as hot press forging using a progressive series of dies and heat-treatment.

Whether the first and second manufacturing processes are the same or different, the first material of the body 102 can be the same as or different than the second material of the strike plate 104. A first material is different than a second material when the first material has a different composition than the second material. Accordingly, materials from the same family, such as steel, but with different compositional characteristics, such as different carbon constituencies, are considered different materials. In one example, the first and second manufacturing processes are different, but the first and second materials are the same. In contrast, according to another example, the first and second manufacturing processes are the same and the first and second materials are different. According to yet another example, the first and second manufacturing processes are different and the first and second materials are different. In some implementations, the first and second materials are different, but come from the same family of similar materials, such as steel. For example, the first material can be 8620 carbon steel and the second material can be 1025 carbon steel. The first material being within the same family as the second material promotes the quality of the weld between the body 102 and the strike plate 104.

The strike plate 104 can be made from maraging steel, maraging stainless steel, or precipitation-hardened (PH) stainless steel. In general, maraging steels have high strength, toughness, and malleability. Being low in carbon, they derive their strength from precipitation of inter-metallic substances other than carbon. The principle alloying element is nickel (15% to nearly 30%). Other alloying elements producing inter-metallic precipitates in these steels include cobalt, molybdenum, and titanium. In one embodiment, the maraging steel contains 18% nickel. Maraging stainless steels have less nickel than maraging steels but include significant chromium to inhibit rust. The chromium augments hardenability despite the reduced nickel content, which ensures the steel can transform to martensite when appropriately heat-treated. In another embodiment, a maraging stainless steel C455 is utilized as the strike plate 104. In other embodiments, the strike plate 104 is a precipitation hardened stainless steel such as 17-4, 15-5, or 17-7.

The body 102 of the golf club head 100 is made from 17-4 steel in one implementation. However another material, such as carbon steel (e.g., 1020, 1030, 8620, or 1040 carbon steel), chrome-molybdenum steel (e.g., 4140 Cr—Mo steel), Ni—Cr—Mo steel (e.g., 8620 Ni—Cr—Mo steel), austenitic stainless steel (e.g., 304, N50, or N60 stainless steel (e.g., 410 stainless steel) can be used.

In addition to those noted above, some examples of metals and metal alloys that can be used to form the components of the parts described include, without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

In still other embodiments, the body 102 and/or the strike plate 104 of the golf club head 100 are made from fiber-reinforced polymeric composite materials, and are not required to be homogeneous. Examples of composite materials and golf club components comprising composite materials are described in U.S. patent application Ser. No. 13/111,715, filed May 19, 2011, which is incorporated herein by reference in its entirety.

The strike plate 104 is welded to the body 102 via a peripheral weld 120. The peripheral weld 120 is peripherally discontinuous because it extends about less than all of the outer periphery of the strike plate 104 such that at least one portion of the outer periphery of the strike plate 104 is not welded to the body 102. In other words, the peripheral weld 120 extends about only a portion of an outer peripheral edge 133 of the strike plate 104. Accordingly, less than 360-degrees of the outer peripheral edge 133 of the strike plate 104 is welded to the body 102. The peripheral weld 120 can be considered a discontinuous weld because it has an ending point that is different than its starting point.

Figure 3:
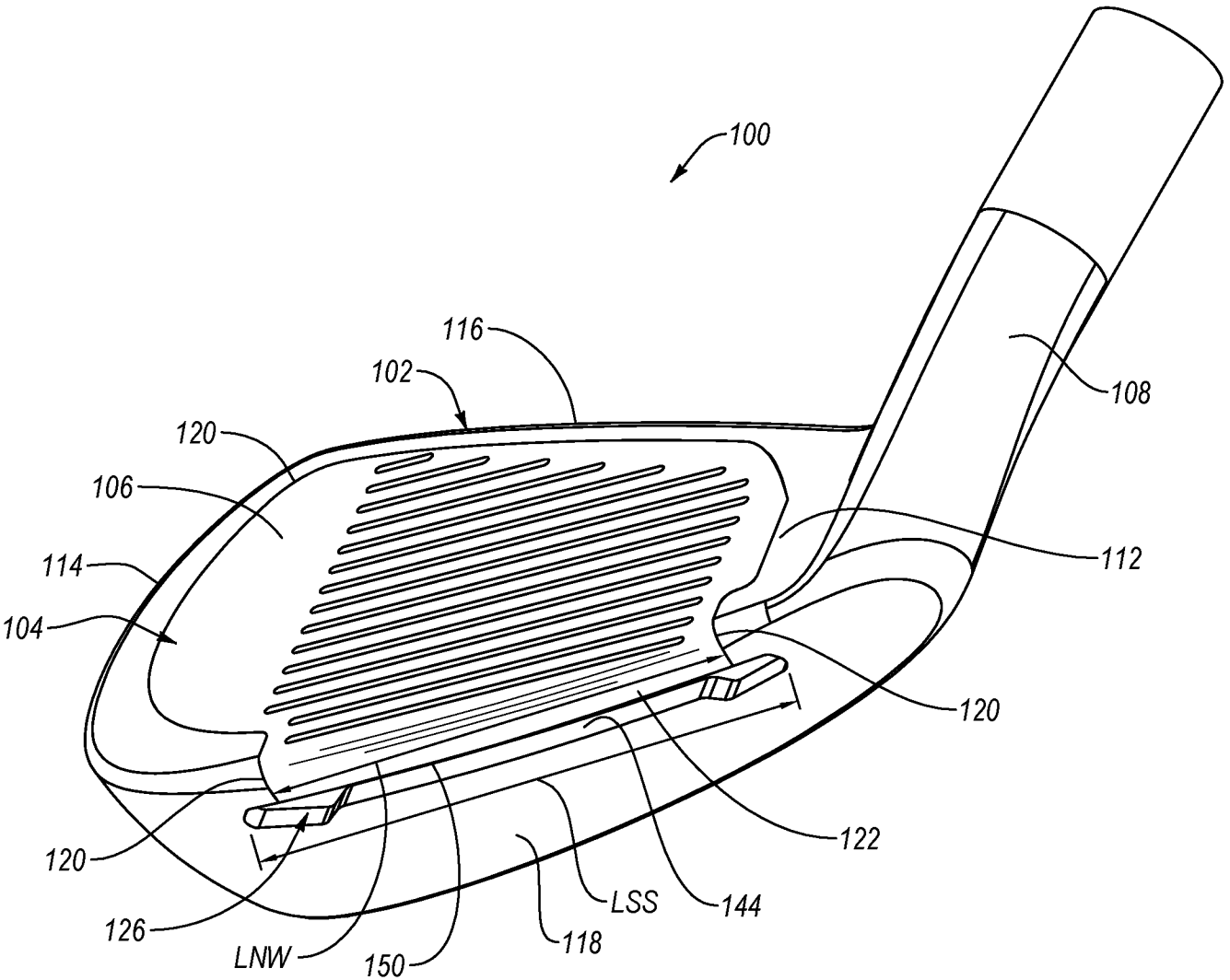
FIG. 3 is perspective view from a bottom of the golf club head of FIG. 1, shown with a filler material removed from a sole slot, according to one or more examples of the present disclosure.

The portion or portions of the outer periphery of the strike plate 104 not being welded to the body 102 promotes an increase in the flexibility of the strike plate 104 relative to the body 102. As shown in FIG. 3, the entirety of the portion of the outer periphery of the strike plate 104 that defines the strike face 106 is welded to the body 102 via the peripheral weld 120. Moreover, the portion of the outer periphery of the strike plate 104 not welded to the body 102 is located along the sole wrap portion 122. More specifically, an outer peripheral edge 133, or perimeter, of the strike plate 104 defined along the sole wrap portion 122 of the strike plate 104 is not welded to the body 102. In the embodiment shown in FIG. 3, not only is the outer peripheral edge 133 of the strike plate 104 not welded to the body 102, but the outer peripheral edge 133 of the strike plate 104 is spaced apart from the body 102 such that a gap is defined between the outer peripheral edge 133 of the strike plate 104 and the body 102. The gap defines a sole slot 126 of the golf club head 100. Generally, the sole slot 126 is a groove or channel formed in a sole of the golf club head 100. The sole slot 126 is elongate in a lengthwise direction substantially parallel to the strike face 106 and has a length LSS (see, e.g., FIG. 3). As shown in FIGS. 1-11, in some implementations, the sole slot 126 is a through-slot, or a slot that is open on a sole portion side of the sole slot 126 and open on an internal cavity side or interior side of the sole slot 126. However, in other implementations, the sole slot 126 is not a through-slot, but rather is closed on an internal cavity side or interior side of the sole slot 126.

The sole slot 126 can be any of various flexible boundary structures (FBS) as described in U.S. Pat. No. 9,044,653, filed Mar. 14, 2013, which is incorporated by reference herein in its entirety. Additionally, or alternatively, the golf club head 100 can include one or more other FBS at any of various other locations on the golf club head 100.

Figure 4:
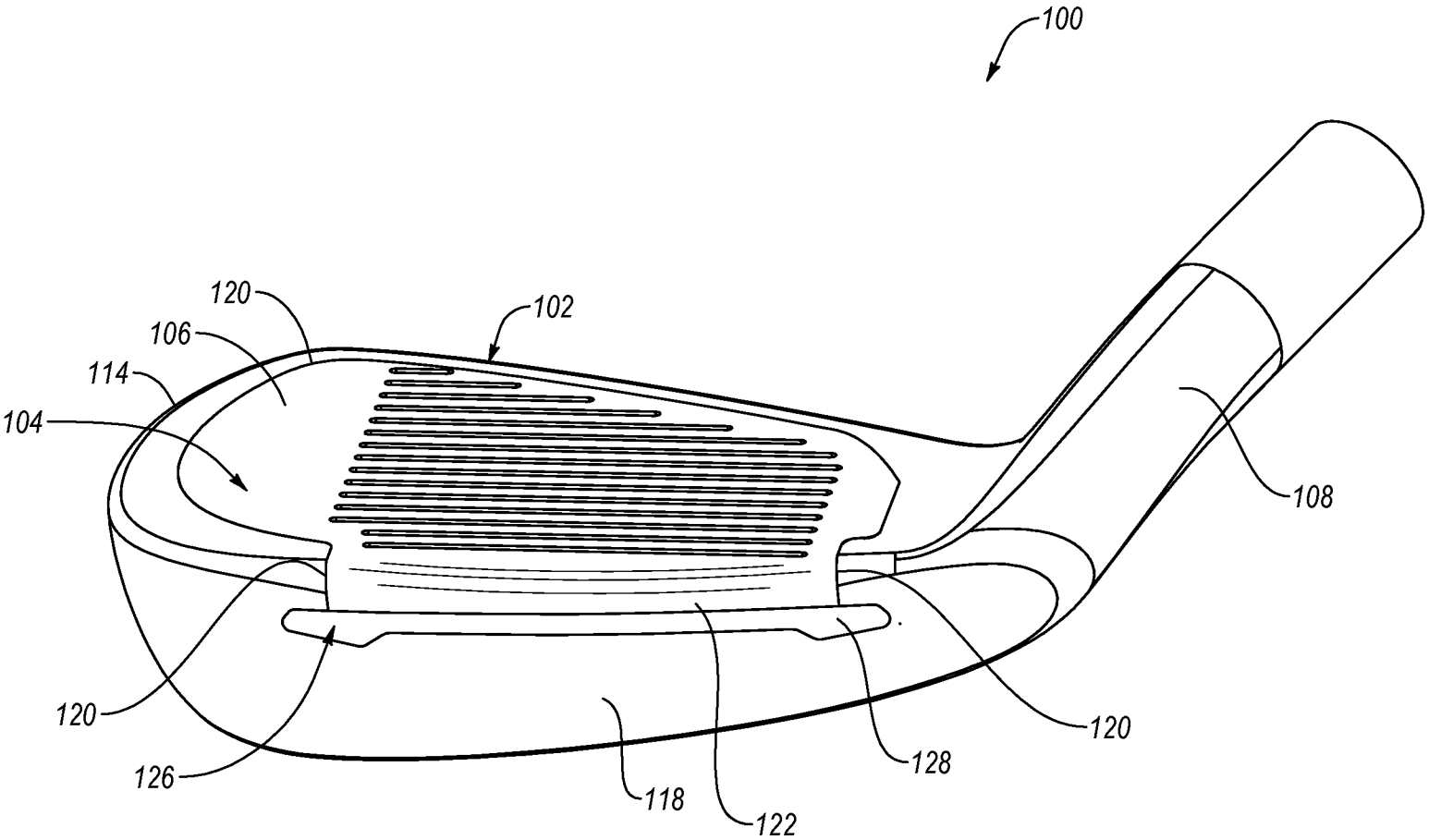
FIG. 4 is a perspective view from a bottom of the golf club head of FIG. 1, shown with the filler material in the sole slot, according to one or more examples of the present disclosure.
Figure 11:
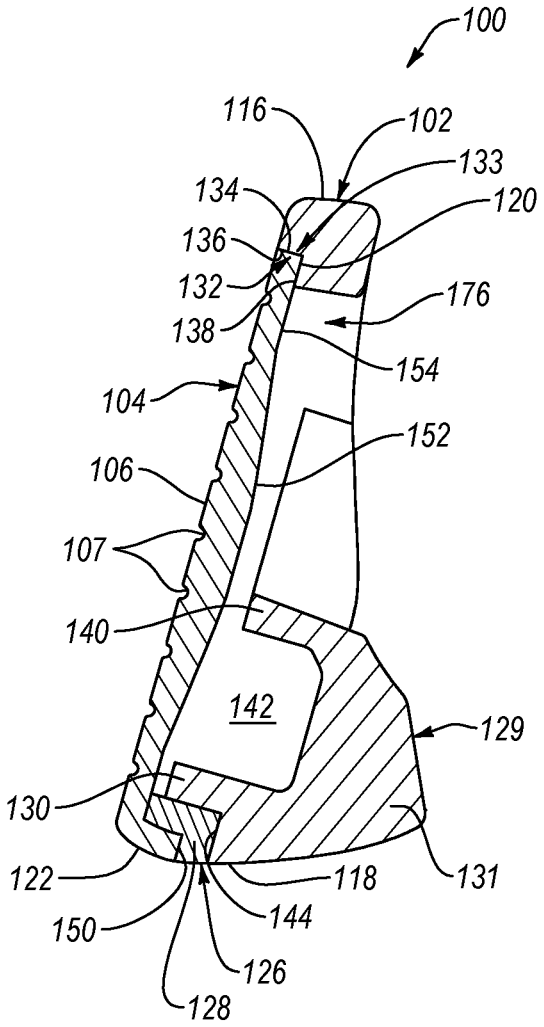
FIG. 11 is cross-sectional side elevation view from a heel side of the golf club head of FIG. 1, taken along the line 10-10 of FIG. 2, according to one or more examples of the present disclosure.

In some implementations, the sole slot 126 is filled with a filler material 128 (see, e.g., FIGS. 4 and 11). The filler material 128 is made from a non-metal, such as a thermoplastic material, thermoset material, and the like, in some implementations. In other implementations, the sole slot 126 is not filled with a filler material 128, but rather maintains an open, vacant, space within the sole slot 126.

According to one embodiments, the filler material 128 is initially a viscous material that is injected or otherwise inserted into the sole slot 126. Examples of materials that may be suitable for use as a filler to be placed into a slot, channel, or other flexible boundary structure include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd. In some embodiments, a solid filler material may be press-fit or adhesively bonded into a slot, channel, or other flexible boundary structure. In other embodiments, a filler material may poured, injected, or otherwise inserted into a slot or channel and allowed to cure in place, forming a sufficiently hardened or resilient outer surface. In still other embodiments, a filler material may be placed into a slot or channel and sealed in place with a resilient cap or other structure formed of a metal, metal alloy, metallic, composite, hard plastic, resilient elastomeric, or other suitable material.

Figure 6:
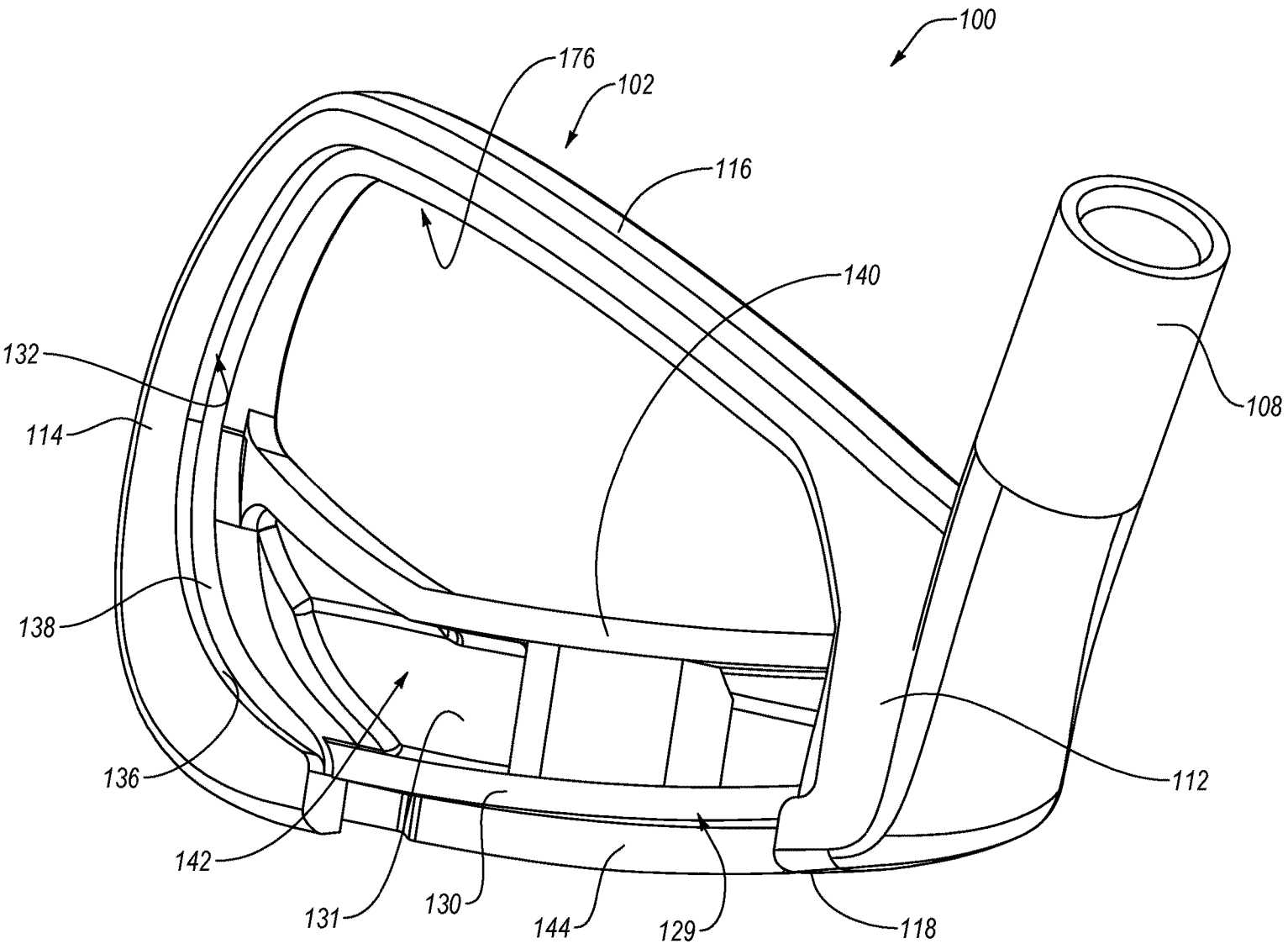
FIG. 6 is a perspective view from a front of the golf club head of FIG. 1, shown with a strike plate removed, according to one or more examples of the present disclosure.

Referring to FIGS. 5 and 6, the body 102 is configured to receive the portions of an outer peripheral edge 133 of the strike plate 104, to be welded to the body 102 via the peripheral weld 120, in seated engagement. More specifically, the body 102 includes a plate opening 176 defined between the toe portion 114, the heel portion 112, the top portion 116, and the sole portion 118 of the body 102. Generally, the plate opening 176 receives the strike plate 104 and helps to secure the strike plate 104 to the body 102. The plate opening 176 extends from a front side of the body 102 to a back side of the body 102. The body 102 additionally includes a plate interface 132 formed in the body 102 along at least a portion of the periphery of the plate opening 176. Generally, the plate interface 132 promotes attachment of the strike plate 104 to the body 102 by supporting the strike plate 104 against the body 102 and promoting the formation of a peripheral weld 120 between the strike plate 104 and the body 102. Accordingly, the plate interface 132 is formed along at least the portion or portions of the periphery of the plate opening 176 that will be welded to the strike plate 104. In the illustrated embodiment of FIGS. 5 and 6, because the strike plate 104 is not welded to the body 102 at the sole portion 118 of the body 102, the plate interface 132 does not extend along the periphery of the plate opening 176 at the sole portion 118 of the body 102. However, in the illustrated embodiment of FIGS. 5 and 6, because the peripheral weld 120 is formed between the strike plate 104 and the body 102 continuously along the heel portion 112, the toe portion 114, and the top portion 116, the plate interface 132 is formed in and extends continuously along the portions of the periphery of the plate opening 176 at the heel portion 112, the toe portion 114, and the top portion 116. According to other embodiments, such as shown in FIGS. 12, 13, and 16-18, because the peripheral weld does not extend along one or more portions of one or more of the heel portion 112, the toe portion 114, and the top portion 116, although not shown, an plate interface may not be present along corresponding portions of the periphery of the plate opening.

Referring again to FIGS. 5 and 6, the plate interface 132 includes a rim 136 and a ledge 138. The rim 136 defines a surface that faces an interior of the body 102 and the ledge 138 defines a surface that faces the front of the body 102. The rim 136 is transverse relative to the ledge 138.

The rim 136 is sized to be substantially flush against or just off of the outer peripheral edge 133 of the strike plate 104. The fit between the rim 136 of the plate interface 132 and the outer peripheral edge 133 of the strike plate 104 facilitates the butt welding together of the rim 136 of the body 102 and the outer peripheral edge 133 of the strike plate 104 with the peripheral weld 120. In other words, the peripheral weld 120 is located between and welds together the rim 136 of the plate interface 132 and the outer peripheral edge 133 of the strike plate 104. As shown in FIG. 6, the rim 136 may extend beyond the plate interface 132, such as along the sole portion 118 of the body 102, to facilitate welding of the welded portions 134 of the outer peripheral edge 133 located on the sole wrap portion 122.

The peripheral weld 120 is formed using any of various welding techniques, such as those disclosed in U.S. Pat. No. 8,353,785, which is incorporated herein by reference in its entirety. Moreover, the characteristics and type (e.g., bead, groove, fillet, surface, tack, plug, slot, friction, and resistance welds) of the peripheral weld 120 can be that same or analogous to those described in U.S. Pat. No. 8,353,785. For example, in one implementation, the peripheral weld 120 is formed using one or more of a tungsten inert gas (TIG) or metal inert gas (MIG) welding technique. In other implementations, the peripheral weld 120 is formed using one or more of a laser welding technique or a plasma welding technique.

The ledge 138 abuts a back surface of the strike plate 104 to support the strike plate 104 in place on the body 102. Additionally, the ledge 138, being abutted against the strike plate 104, facilitates the transfer of ball-striking loads from the strike plate 104 to the body 102.

Figure 10:
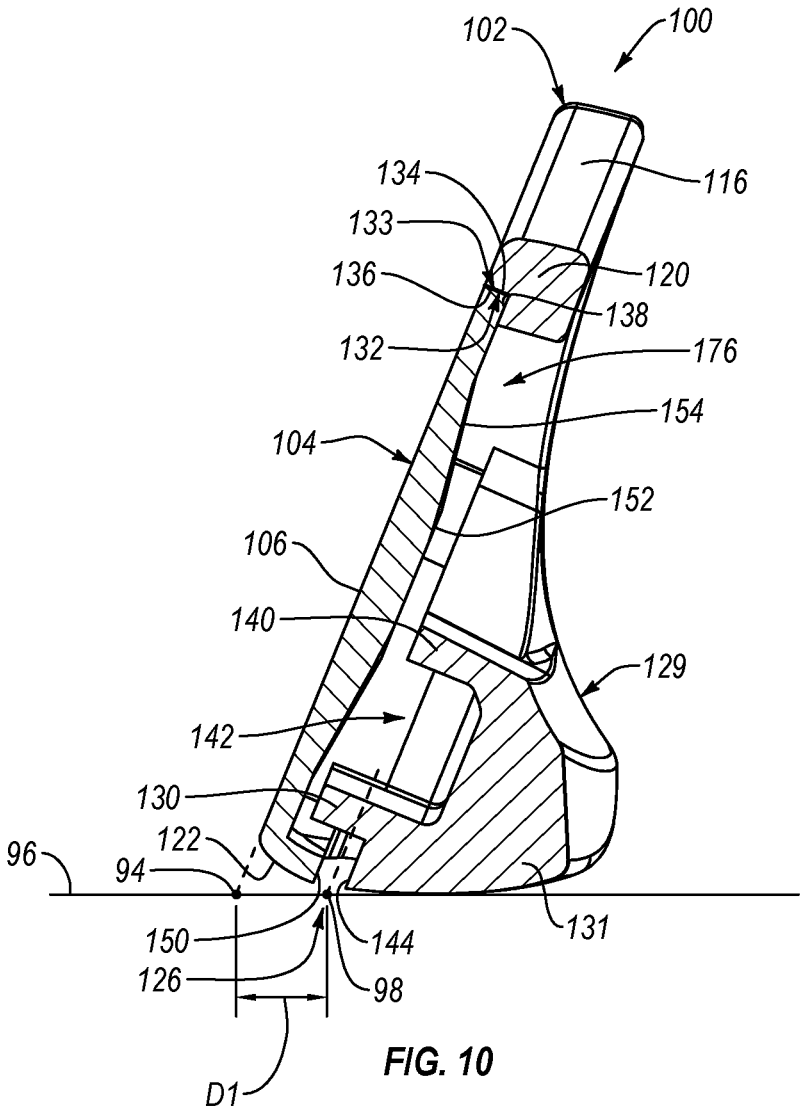
FIG. 10 is cross-sectional perspective view from a heel side of the golf club head of FIG. 1, taken along the line 10-10 of FIG. 2, according to one or more examples of the present disclosure.

Referring still to FIGS. 5 and 6, as well as FIGS. 10 and 11, the body 102 further includes a back portion 129 coupled to and extending rearwardly from the sole portion 118. The back portion 129 is also coupled to and extends rearwardly from lower parts of the heel portion 112 and the toe portion 114. The back portion 129 includes a sole bar 131, which is located in a low, rearward portion of the golf club head 100. The sole bar 131 has a relatively large thickness in relation to the strike plate and other portions of the golf club head 100, thereby accounting for a significant portion of the mass of the golf club head 100, and thereby shifting a center of gravity (CG) of the golf club head 100 relatively lower and rearward. The back portion 129 also includes a lower shelf 130 and an upper shelf 140 protruding forwardly of the sole bar 131. The lower shelf 130 and the upper shelf 140 are spaced rearwardly of the strike plate 104 such that a gap is defined between each of the lower shelf 130 and the upper shelf 140 of the back portion 129. Defined between the lower shelf 130 and the upper shelf 140 is a portion of an internal cavity 142, which may extend upwards to the top portion 116. In the illustrated implementation, the internal cavity 142 is open to the sole slot 126. The plate opening 176 is partially open to the back of the body 102.

Figure 7:
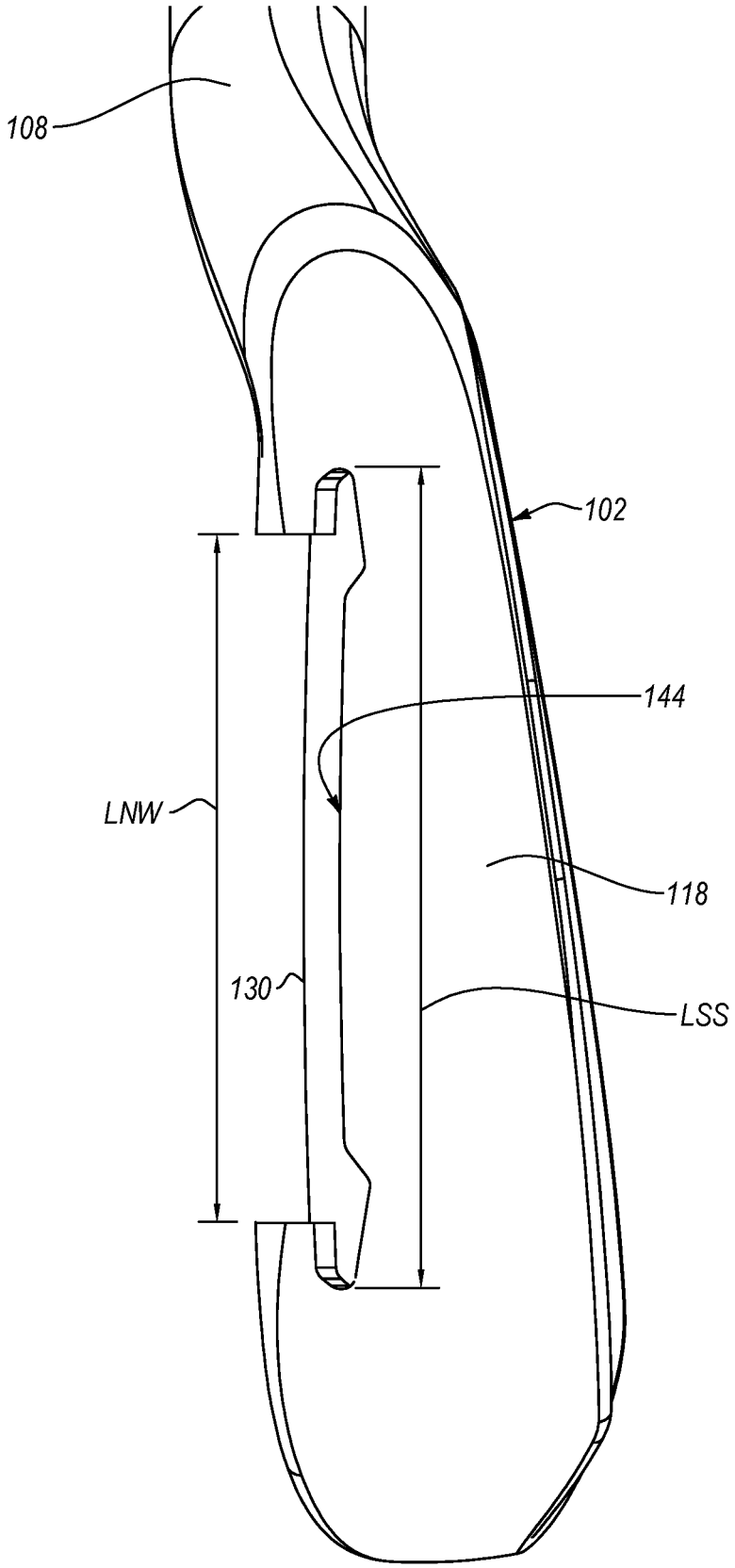
FIG. 7 is a bottom view of the golf club head of FIG. 1, shown with the strike plate removed, according to one or more examples of the present disclosure.

Referring to FIG. 7, a slot edge 144 is formed in the sole portion 118 of the body 102. The slot edge 144 is elongate and extends lengthwise along the sole portion 118 in a direction substantially parallel to the strike face 106. The slot edge 144 is open to or faces the plate opening 176. However, as shown, in some implementations, opposing ends of the slot edge 144 may have a substantially buttonhook shape such that opposing end portions of the slot edge 144 face away from the plate opening 176.

Figure 8:
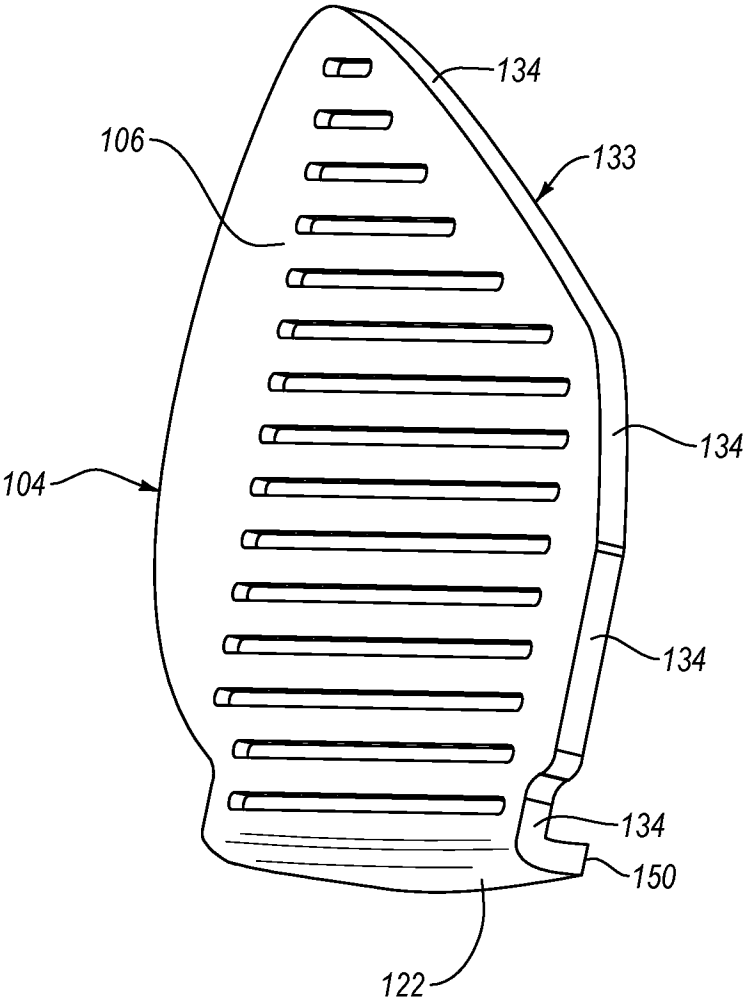
FIG. 8 is a perspective view from a front of the strike plate of the golf club head of FIG. 1, according to one or more examples of the present disclosure.
Figure 9:
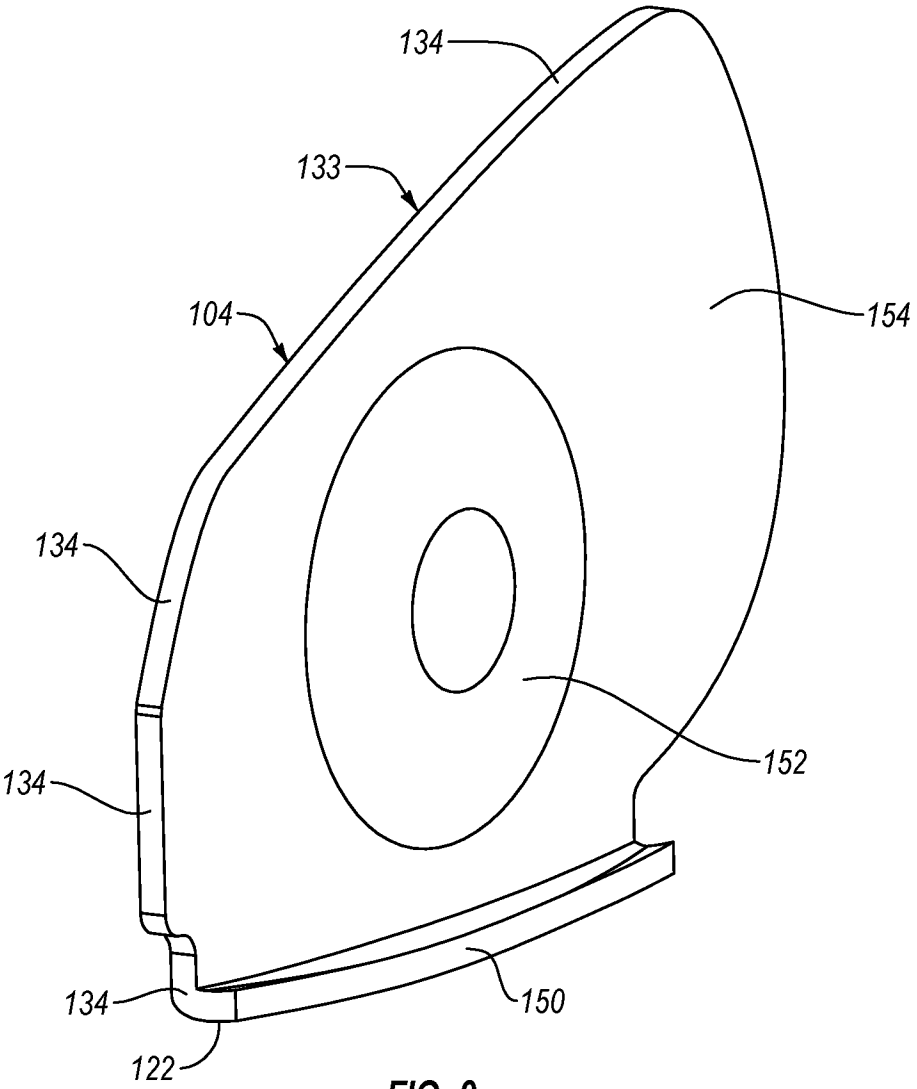
FIG. 9 is a perspective view from a back of the strike plate of the golf club head of FIG. 1, according to one or more examples of the present disclosure.

Referring to FIGS. 8 and 9, the strike plate 104 has a back surface 154 that opposes the strike face 106. The strike plate 104 includes an inverted cone 152 protruding from the back surface 154. Generally, the inverted cone 152 is aligned with an ideal striking location on the strike face 106. The inverted cone 152 promotes a larger sweet spot for the golf club head 100, which facilitates a reduction in loss of distance on misfits. The outer peripheral edge 133 extends along and defines that outermost periphery of the strike plate 104. The outer peripheral edge 133 of the strike plate 104 includes at least one welded portion 134 and at least one non-welded portion 150. In the illustrated embodiment of FIGS. 8 and 9, the welded portion 134 of the strike plate 104 is a continuous edge that extends from one end of the non-welded portion 150, along the sole wrap portion 122, around the strike face 106, and along an opposite end of the non-welded portion. The non-welded portion 150 extends along an entire length of the sole wrap portion 122 and faces a direction that is substantially perpendicular to that of the welded portion 134.

Referring now to FIGS. 10 and 11, the sole wrap portion 122 effectively wraps around the sole portion 118 of the body 102 to define a portion of the bottom of the golf club head 100. Accordingly, the sole wrap portion 122 is angled relative to the strike face 106. In the illustrated embodiment of FIGS. 10 and 11, the sole wrap portion 122 also effectively wraps around the lower shelf 130 of the back portion 129. The non-welded portion 150 of the outer peripheral edge 133 of the strike plate 104 faces the slot edge 144 of the body 102. In one implementation, the non-welded portion 150 is parallel to the slot edge 144 and has a length LNW (see, e.g., FIG. 3). The gap defined between the non-welded portion 150 of the outer peripheral edge 133 and the slot edge 144 defines the sole slot 126 of the golf club head 100. Accordingly, the non-welded portion 150 defines a forward slot wall of the sole slot 126 and the slot edge 144 defines a rearward slot wall of the sole slot 126. There is no weld between the non-welded portion 150 of the outer peripheral edge 133 of the strike plate 104 and the slot edge 144. In contrast, there is a weld between the welded portion 134 of the outer peripheral edge 133 of the strike plate 104 and the rim 136 of the body 102.

As shown in FIG. 10, a distance D1 between a first point 94 (which is the point at which the strike face 106 projects onto the ground plane 96 when the golf club head 100 is in a proper address position on the ground plane 96) and a second point 98 (which is the point at which a plane bisecting the sole slot 126 projects onto the ground plane 96 when the golf club head 100 is in a proper address position on the ground plane 96) is between about 3.5 mm and about 8 mm in some implementations, and between about 4 mm and about 7 mm in other implementations.

To effectively plug the sole slot 126, and prevent debris (e.g., water, grass, dirt, etc.) from entering the internal cavity 142, the filler material 128 is located within the slot 126. The filler material 128 may also help to achieve other desired performance objectives, including desired changes to the sound and feel of the club head by damping vibrations that occur when the club head strikes a golf ball. Because the filler material 128 does not fuse with either the body 102 or the strike plate 104, the filler material 128 is not considered a weld. Moreover, because the filler material 128 is considerably weaker than either the body 102 or the strike plate 104, the filler material 128 is not considered a weld. Additionally, because the filler material 128 is a non-metal, it is not considered a weld.

According to some embodiments, a total peripheral length of the outer peripheral edge 133 of the strike plate 104 of the golf club head 100 is between about 185 mm and about 220 mm or between about 209 mm and about 214 mm. In some embodiments, a height of the heel portion 112 of the body 102 is between about 25 mm and about 27 mm. In certain embodiments, a height of the toe portion 114 of the body 102 is between about 50 mm and about 52 mm. In yet some embodiments, a length of the sole portion 118 of the body 102 is between about 58 mm and about 64 mm. According to some embodiments, a total length of the body 102 is between about 53 mm and about 65 mm. In certain embodiments, a width of the sole portion 118 at the heel of the golf club head 100 is between about 10 mm and about 12 mm.

Referring now to FIGS. 12-15, respective embodiments of a golf club head 200, a golf club head 300, and a golf club head 400 are shown. The respective golf club heads of FIGS. 12-15 are analogous to the golf club head 100 of FIGS. 1-11, with like numbers referring to like features. More specifically, features of the golf club heads of FIGS. 12-15 that are analogous to features of the golf club head 100 have the same number, but in a different series (e.g., 200-series, 300-series, 400-series, etc.) format rather than the 100-series format of the golf club head 100. Therefore, unless otherwise noted, the description, including the structure, function, and advantages, of the features of the golf club head 100 presented above are applicable to the analogous features of the respective golf club heads of FIGS. 12-15.

Like the golf club head 100 of FIGS. 1-11, each of the golf club head 200, the golf club head 300, and the golf club head 400 includes at least one slot partially defined by a non-welded portion of a strike plate. However, unlike the golf club head 100 of FIGS. 1-11, the at least one slot of each of the golf club head 200, the golf club head 300, and the golf club head 400 is not a sole slot (e.g., a slot formed in the sole portion of the golf club head). Rather, the slots of the golf club head 200, the golf club head 300, and the golf club head 400 are face slots (e.g., slots formed in or directly adjacent the strike face of the golf club head). Additionally, although not shown, each of the face slots of the various illustrated embodiments described below can be filled with a filler material.

Figure 12:
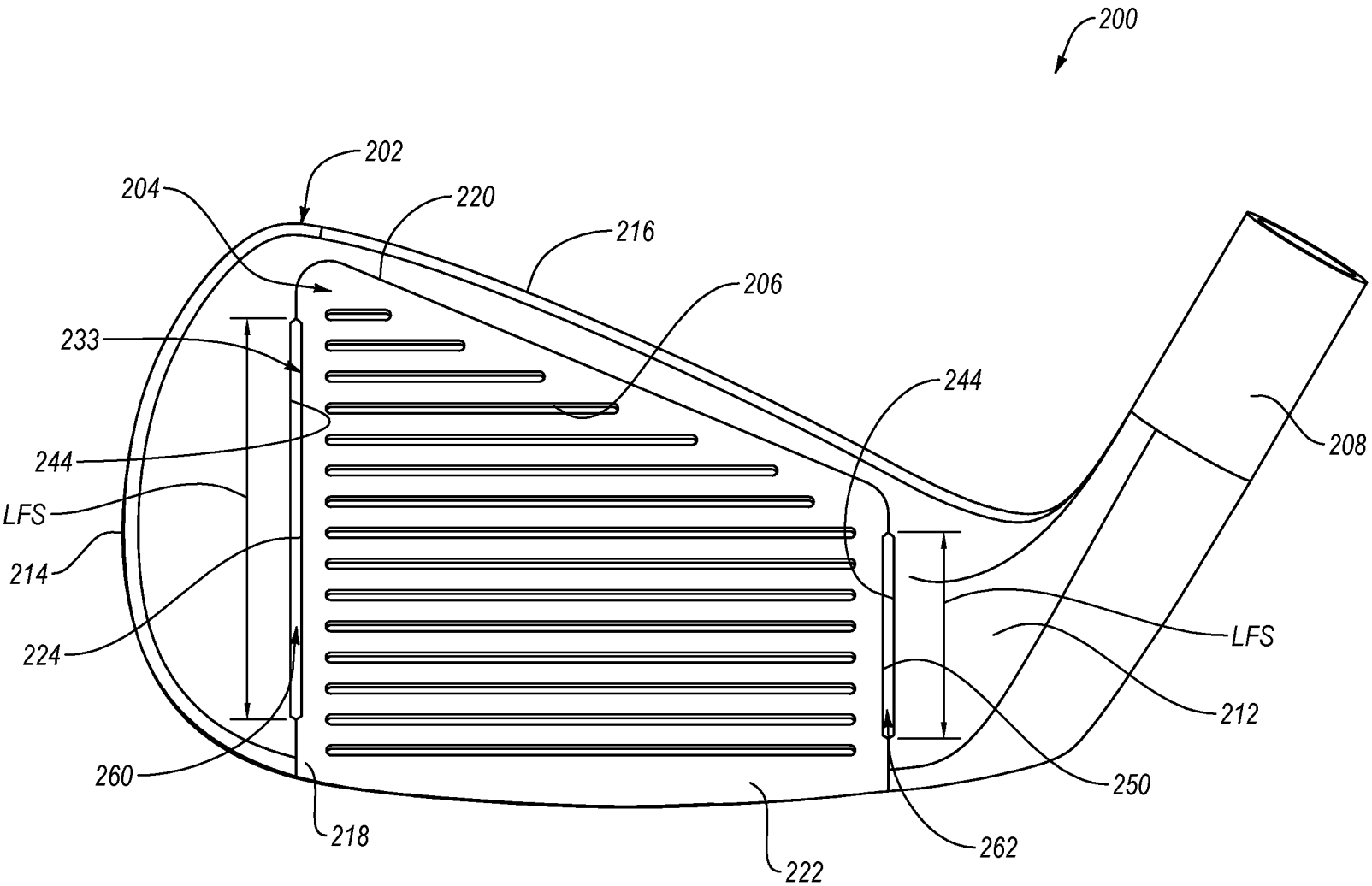
FIG. 12 is a front view of an iron-type golf club head, according to one or more examples of the present disclosure.
Figure 13:
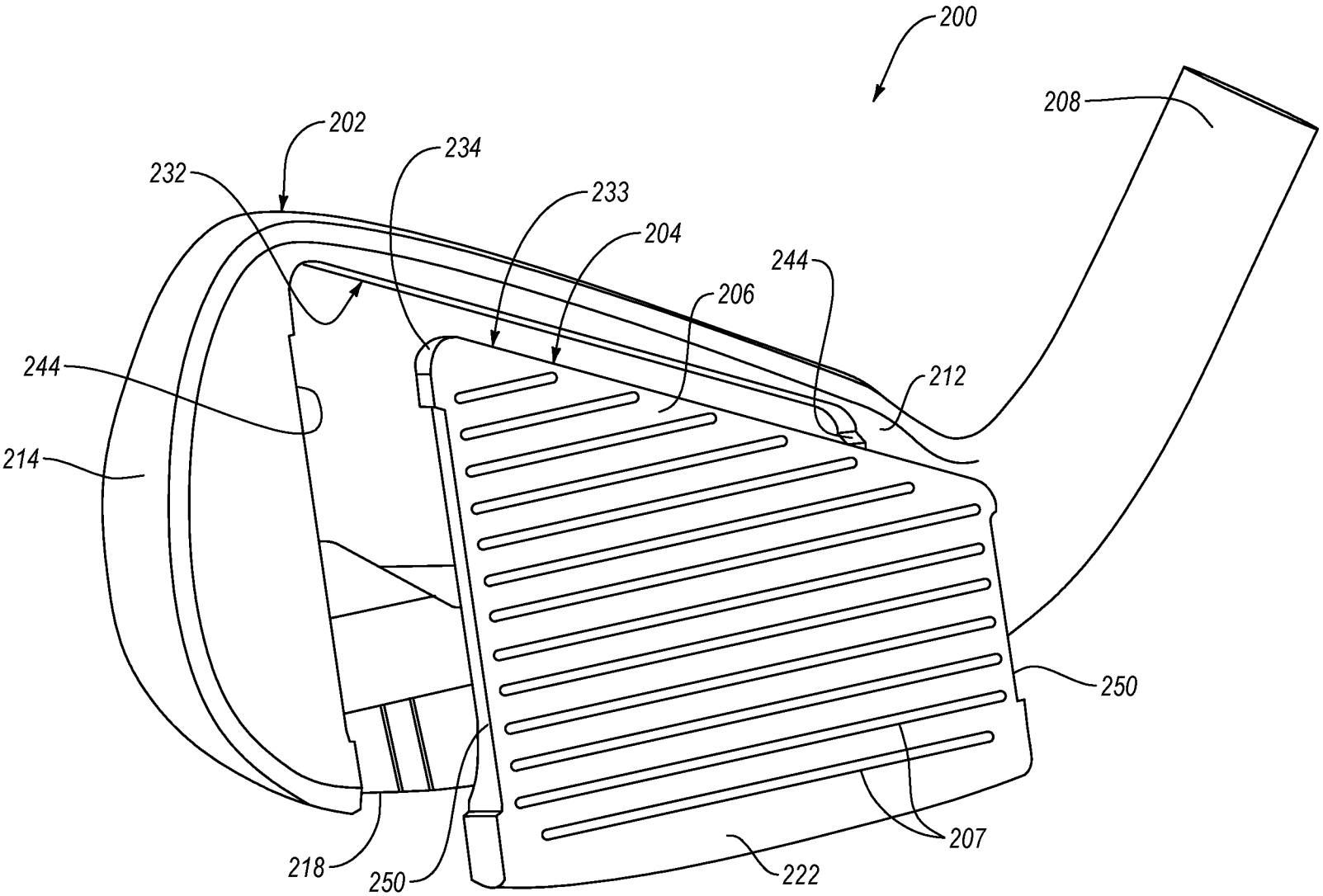
FIG. 13 is an exploded perspective view from a front of the golf club head of FIG. 12, according to one or more examples of the present disclosure.

For example, referring to FIGS. 12 and 13, the golf club head 200 includes a face slot 260 at a toe portion 214 of the body 202 and a face slot 262 at a heel portion 212 of the body 202. Each of the face slots 260, 262 is defined between a respective non-welded portion 250 of the outer peripheral edge 233 of the strike plate 204 and a respective slot edge 244 of the body 202. The remaining portions of the outer peripheral edge 233 of the strike plate 204 are welded portions welded to the body 202 via the peripheral weld 220. As shown, in one example, each of the non-welded portions 250 of the outer peripheral edge 233 of the strike plate 204 and the slot edges 244 of the body 202 define a groove formed into the respective outer peripheral edge 233 and the body 202. Opposing grooves of a non-welded portion 250 and a slot edge 244 together define a respective one of the face slots 260, 262.

Different than the golf club head 100, the peripheral weld 220 is made up of two separate weld sections, as opposed to a single weld section as with the peripheral weld 120. Put another way, the outer peripheral edge 233 of the strike plate 204 includes two welded portions separated from each other by the two non-welded portions 250. The welded portions of the peripheral weld 220 are located adjacent the top portion 216 of the body 202 and the sole portion 218 of the body 202, respectively. The face slots 260, 262 at the heel portion 212 and the toe portion 214, respectively, of the golf club head 200 promotes flexibility and deflection of the golf club head 200 for heel-ward and toe-ward off-center hits, respectively, which improves the performance of the golf club head 200.

Figure 14:
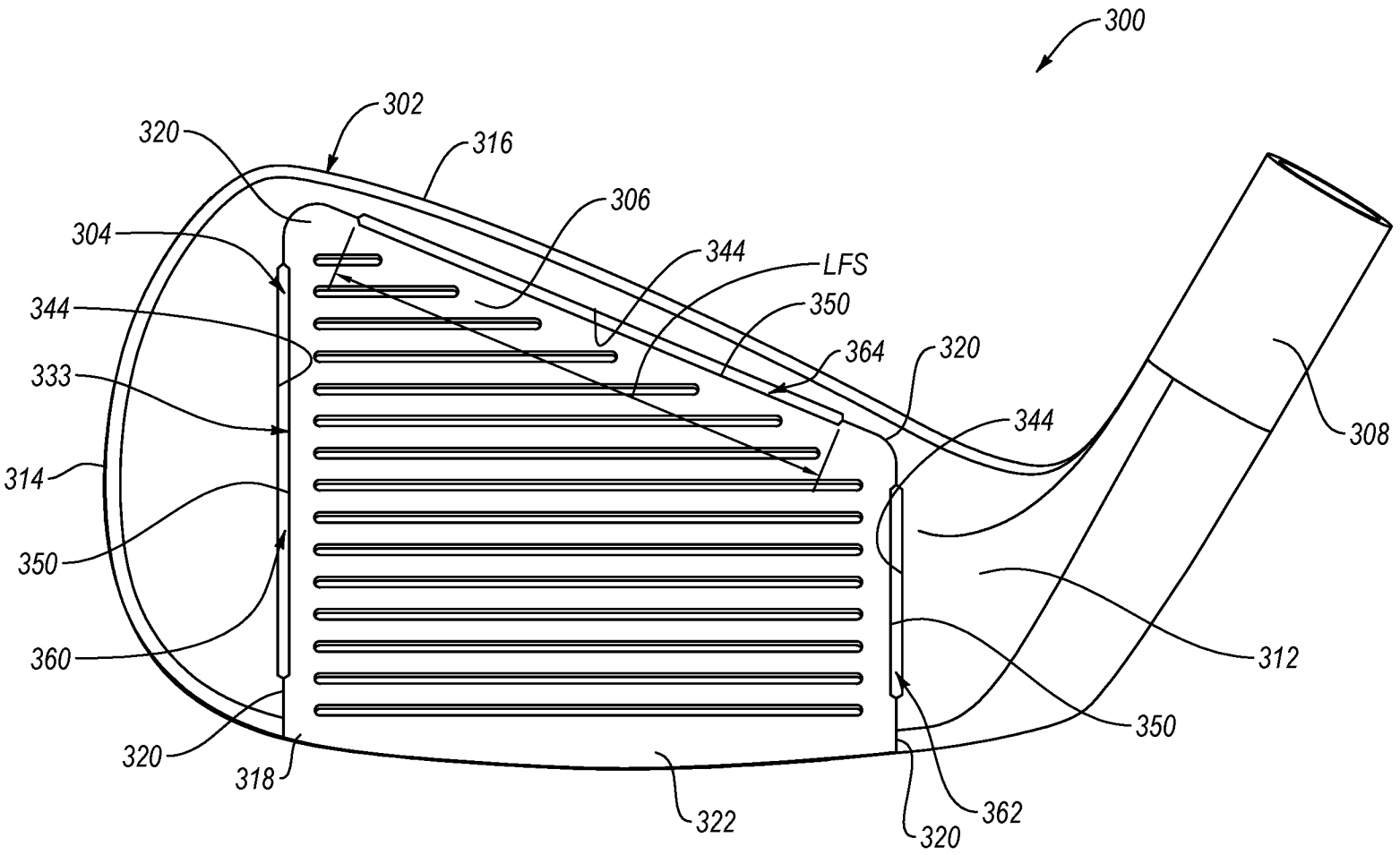
FIG. 14 is a front view of an iron-type golf club head, according to one or more examples of the present disclosure.

As another example, referring to FIG. 14, the golf club head 300 includes a face slot 360 at a toe portion 314 of the body 302, a face slot 362 at a heel portion 312 of the body 302, and a face slot 364 at a top portion 316 of the body 302. Each of the face slots 360, 362, 364 is defined between a respective non-welded portion 350 of the outer peripheral edge 333 of the strike plate 304 and a respective slot edge 344 of the body 302. The remaining portions of the outer peripheral edge 333 of the strike plate 304 are welded portions welded to the body 302 via the peripheral weld 320. Different than the golf club head 200, the peripheral weld 320 is made up of three separate weld sections, as opposed to two weld sections as with the peripheral weld 220. Put another way, the outer peripheral edge 333 of the strike plate 304 includes three welded portions separated from each other by the three non-welded portions 350. The welded portions of the peripheral weld 320 are located adjacent the sole portion 318 of the body 202, adjacent an intersection of the toe portion 314 and top portion 316, and adjacent an intersection of the heel portion 312 and the top portion 316, respectively. The face slots 360, 362, 364 at the heel portion 312, toe portion 314, and top portion 316, respectively, of the golf club head 300 promotes flexibility and deflection of the golf club head 200 for heel-ward, toe-ward, and high off-center hits, respectively, which improves the performance of the golf club head 200.

Figure 15:
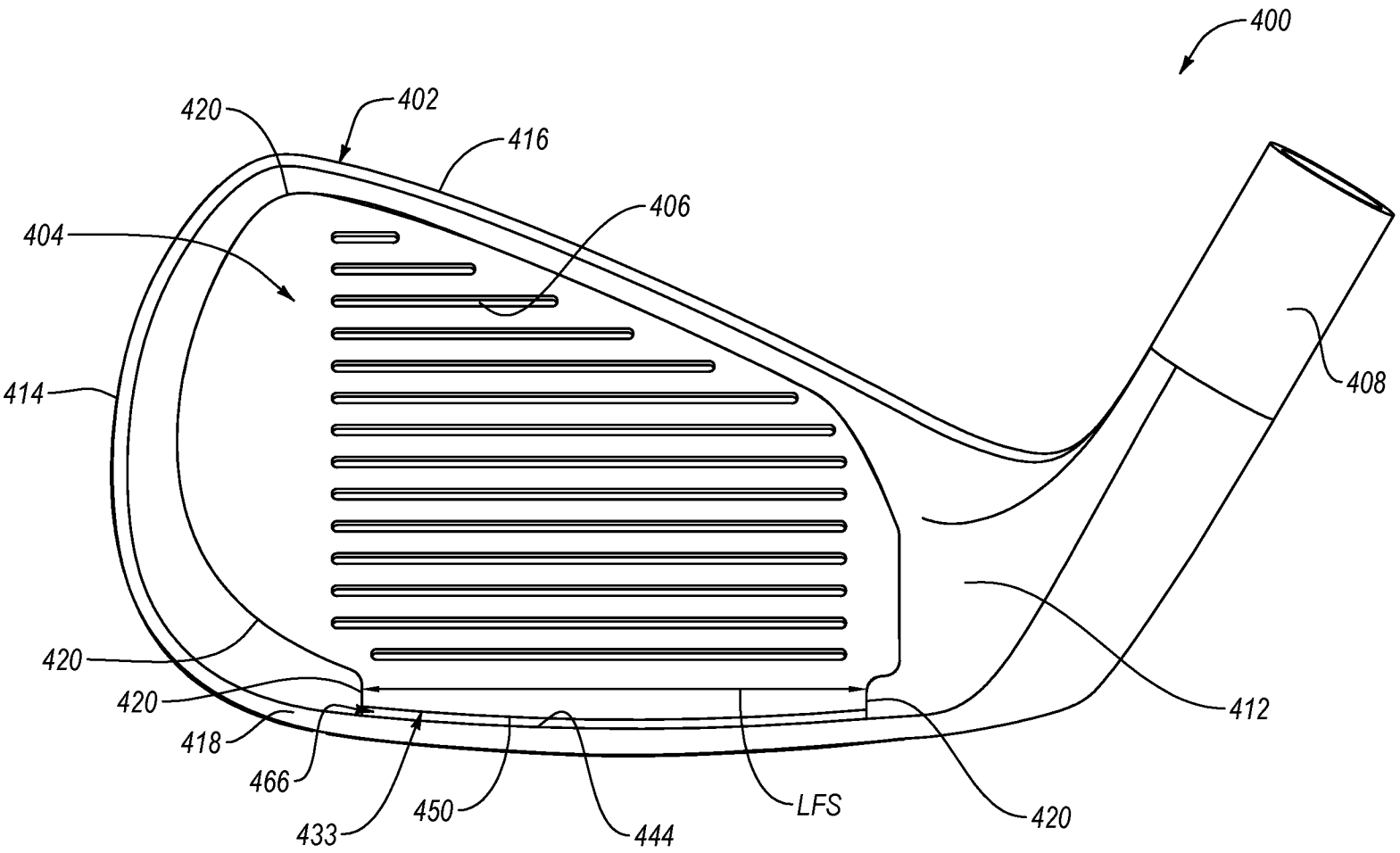
FIG. 15 is a front view of an iron-type golf club head, according to one or more examples of the present disclosure.

According to another example, referring to FIG. 15, the golf club head 400 includes a face slot 466 at a sole portion 418 of the body 202. The face slot 266 is defined between a non-welded portion 450 of the outer peripheral edge 433 of the strike plate 404 and a slot edge 444 of the body 402. The remaining portions of the outer peripheral edge 433 of the strike plate 404 are welded portions welded to the body 402 via the peripheral weld 420. The face slot 466 at the sole portion 418 of the golf club head 400 promotes flexibility and deflection of the golf club head 400 for low off-center hits, which improves the performance of the golf club head 400.

Generally, each of the face slots of the various embodiments of a golf club head is a groove or channel formed in a portion of the face (e.g., adjacent a strike face) of the golf club head. The face slots are elongate in a lengthwise direction and each has a length LFS. Although the sole slots and face slots of the present disclosure are substantially straight in the illustrated embodiments, in other embodiments, the sole slots and face slots can be curved or non-straight. As shown in FIGS. 12-15, in some implementations, the face slots are through-slots, or slots that are open on a strike face side of the face slots and open on an internal cavity side or back side of the face slots. However, in other implementations, the face slots are not through-slots, but rather are closed on an internal cavity side or back side of the face slots.

Although FIGS. 12-15 illustrate golf club heads with several different configurations of face slots, it is recognized that golf club heads can have other configurations of face slots without departing from the essence of the present disclosure. For example, a golf club head may have four separate face slots, one at each of the heel portion, toe portion, top portion, and sole portion of the golf club head. Moreover, although the golf club heads illustrated in FIGS. 12-15 show a single face slot per respective heel, toe, top, and sole portion of the golf club head, in other embodiments, the golf club head includes two or more face slots at one or more of the heel, toe, top, and sole portions of the golf club head.

Referring to FIGS. 16-19, various golf club heads are shown with the placement of weld contours being emphasized by heavier or darker lines. Each of the golf club heads includes a strike plate that is welded to a body. Moreover, the golf club heads 500B-D are analogous to the golf club head 100, with like numbers referring to like features. More specifically, features of the golf club heads of FIGS. 17-19 that are analogous to features of the golf club head 100 have the same number, but in a different series (e.g., 500-series) format rather than the 100-series format of the golf club head 100. Therefore, unless otherwise noted, the description, including the structure, function, and advantages, of the features of the golf club head 100 presented above are applicable to the analogous features of the respective golf club heads of FIGS. 17-19.

Figure 16:
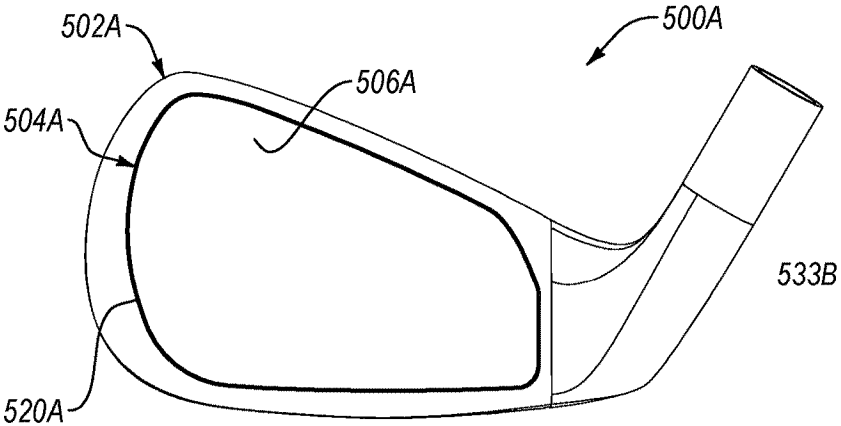
FIG. 16 PRIOR ART
FIG. 16 is a front view of an iron-type golf club head, according to the prior art.

A representation of a conventional golf club head 500A is shown in FIG. 16. The golf club head 500A has a continuous weld 520A or a weld that extends around 360-degrees of the outer peripheral edge of the strike plate 504A. In contrast, the golf club head 500B shown in FIG. 17 has a peripheral weld 520B or a weld that does not extend around 360-degrees of the outer peripheral edge 533B of the strike plate 504B. More specifically, the peripheral weld 520B extends about only a portion (e.g., a portion adjacent the top portion 516B and a portion adjacent the sole portion 518B) of the outer peripheral edge 533B of the strike plate 504B. Accordingly, the outer peripheral edge 533B includes two welded portions 534B each adjacent a respective one of the top portion 516B and the sole portion 518B. The remaining portions of the outer peripheral edge 533B of the strike plate 504B are non-welded portions 550B located adjacent the heel portion 512B and toe portion 514B, respectively, of the body 502B.

Figure 17:
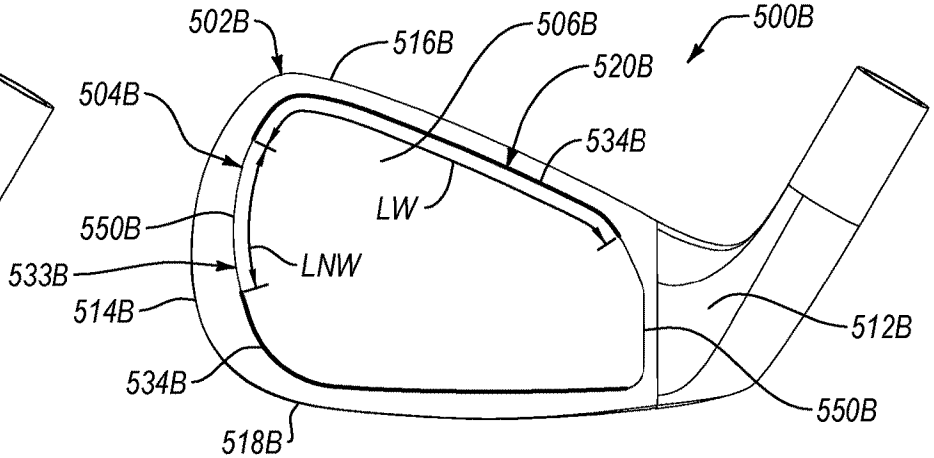
FIG. 17 is a front view of an iron-type golf club head, according to one or more examples of the present disclosure.
Figure 18:
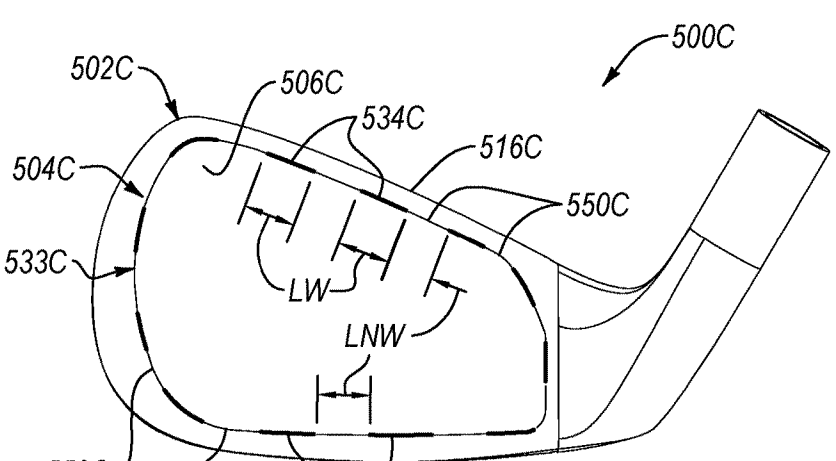
FIG. 18 is a front view of an iron-type golf club head, according to one or more examples of the present disclosure.

Like the golf club head 500B shown in FIG. 17, the golf club head 500C of FIG. 18 has a peripheral weld 520C or a weld that does not extend around 360-degrees of the outer peripheral edge 533C of the strike plate 504C. However, unlike the golf club head 500B, the peripheral weld 520C of the golf club head 500C includes multiple welded portions at each of the heel portion 512C, the toe portion 514C, the top portion 516C, and the sole portion 518C of the body 502C. Accordingly, the outer peripheral edge 533C includes at least two welded portions 534C adjacent each of the heel portion 512C, the toe portion 514C, the top portion 516C, and the sole portion 518C of the body 502C. The remaining portions of the outer peripheral edge 533C of the strike plate 504C are non-welded portions 550C where at least two non-welded portions 550C are located adjacent each of the heel portion 512C, the toe portion 514C, the top portion 516C, and the sole portion 518C of the body 502C. The peripheral weld 520C can be described to have a stitch pattern about the strike plate 504C.

Similar to the golf club head 500B of FIG. 17, the golf club head 500D shown in FIG. 18 has a peripheral weld 520D or a weld that does not extend around 360-degrees of the outer peripheral edge 533D of the strike plate 504D. However, the peripheral weld 520D is configured such that the outer peripheral edge 533D of the strike plate 504D includes four welded portions 534B each at a respective one of four corners the outer peripheral edge 533D. The remaining portions of the outer peripheral edge 533D of the strike plate 504D are non-welded portions 550D each located adjacent a respective one of the heel portion 512D, toe portion 514D, top portion 516D, and sole portion 518D, respectively, of the body 502D.

Figure 19:
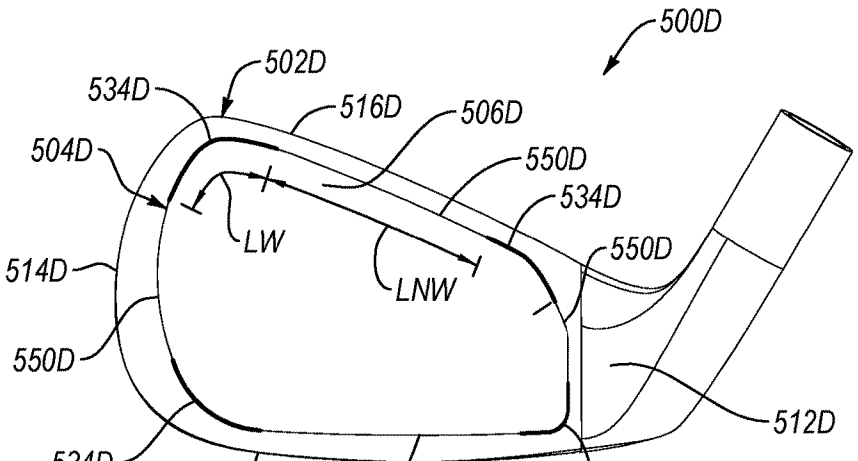
FIG. 19 is a front view of an iron-type golf club head, according to one or more examples of the present disclosure.

Although the golf club heads 500B-D are not shown to have face slots like the respective golf club heads 200, 300, 400 of FIGS. 12-15, it is recognized that at any one or more of the non-welded portions of the outer peripheral edge of the strike plate of the golf club heads 500B-D of FIGS. 17-19, the golf club head can include a face slot that is partially defined by a corresponding one of the non-welded portions.

Referring to the golf club head 100 of FIGS. 1-11 and 17-19, but applicable to all embodiments of the golf club head of the present disclosure, the outer peripheral edge 133 of the strike plate 104 has a total peripheral length. The total peripheral length of the outer peripheral edge 133 is defined as the distance, circumferentially along the outer peripheral edge 133, between a starting point and an ending point at the same location as the starting point. Similarly, the peripheral weld 120 has a total weld length. For a peripheral weld 120 that has multiple weld segments or sections, the total weld length of the peripheral weld 120 is defined as the sum of the individual weld lengths of the weld segments. Moreover, the individual length of a weld segment is equal to the individual length LW of the welded portion 134 of the outer peripheral edge 133 defined by the weld segment. Accordingly, the total weld length of the peripheral weld 120 is equal to a total length of the welded portion 134 of the outer peripheral edge 133 of the strike plate 104. For an outer peripheral edge 133 that has multiple welded portions 134, the total length of the welded portion 134 is defined as the sum of the individual lengths LW of the welded portions 150. Correspondingly, a total length of the non-welded portion 150 of the outer peripheral edge 133 is equal to the difference between the total peripheral length of the outer peripheral edge 133 and the total length of the welded portion 134 of the outer peripheral edge 133. For an outer peripheral edge 133 that has multiple non-welded portions 150, the total length of the non-welded portion 150 is defined as the sum of the individual lengths LNW of the non-welded portions 150.

Based on the foregoing, a ratio of the total length of the welded portion(s) 134 of the outer peripheral edge 133 to the total peripheral length of the strike plate 104 is less than one. In some implementations, the ratio of the total length of the welded portion(s) 134 of the outer peripheral edge 133 to the total peripheral length of the strike plate 104 is between about 0.40 and about 0.94. In yet certain implementations, the ratio of the total length of the welded portion(s) 134 of the outer peripheral edge 133 to the total peripheral length of the strike plate 104 is between about 0.45 and about 0.80. According to further implementations, the ratio of the total length of the welded portion(s) 134 of the outer peripheral edge 133 to the total peripheral length of the strike plate 104 is between about 0.70 and about 0.75.

Referring to FIG. 17, for example, in some embodiments, the length LW of each welded portion 534B of the outer peripheral edge 533B is more than the length LNW of each non-welded portion 550B of the outer peripheral edge 533B. However, in other embodiments, such as shown in FIG. 19, for example, the length LW of each welded portion 534D of the outer peripheral edge 533D is less than the length LNW of each non-welded portion 550D of the outer peripheral edge 533D. As also shown in FIG. 19, for example, in certain embodiments, at least two (e.g., all in some implementations) of the welded portions 534D of the outer peripheral edge 533D have different lengths. However, in other embodiments, such as shown in FIG. 18, for example, at least two of the welded portions 534C of the outer peripheral edge 533C have the same length. According to some implementations, all of the welded portions 534C of the outer peripheral edge 533C have the same length.

Figure 20:
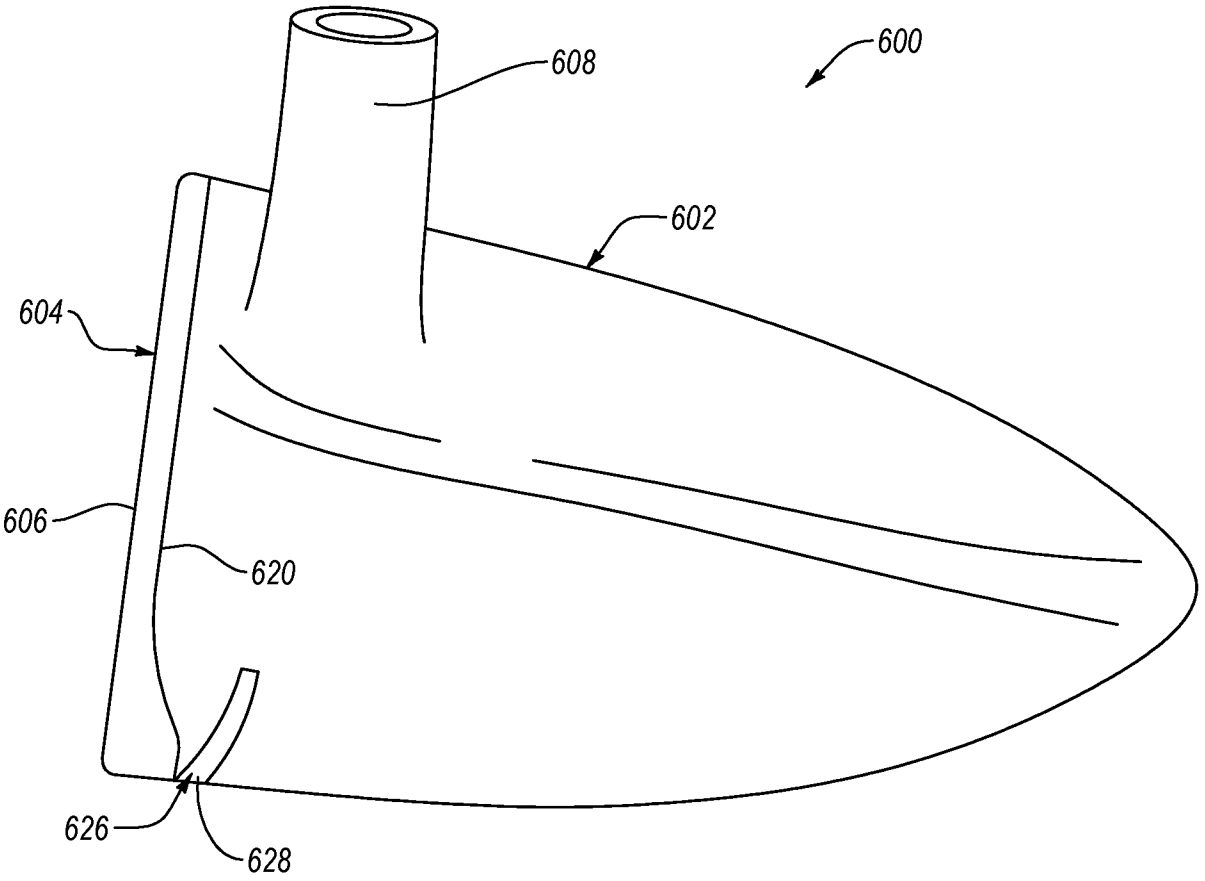
FIG. 20 is a side elevation view of a metal-wood-type golf club head, according to one or more examples of the present disclosure.
Figure 21:
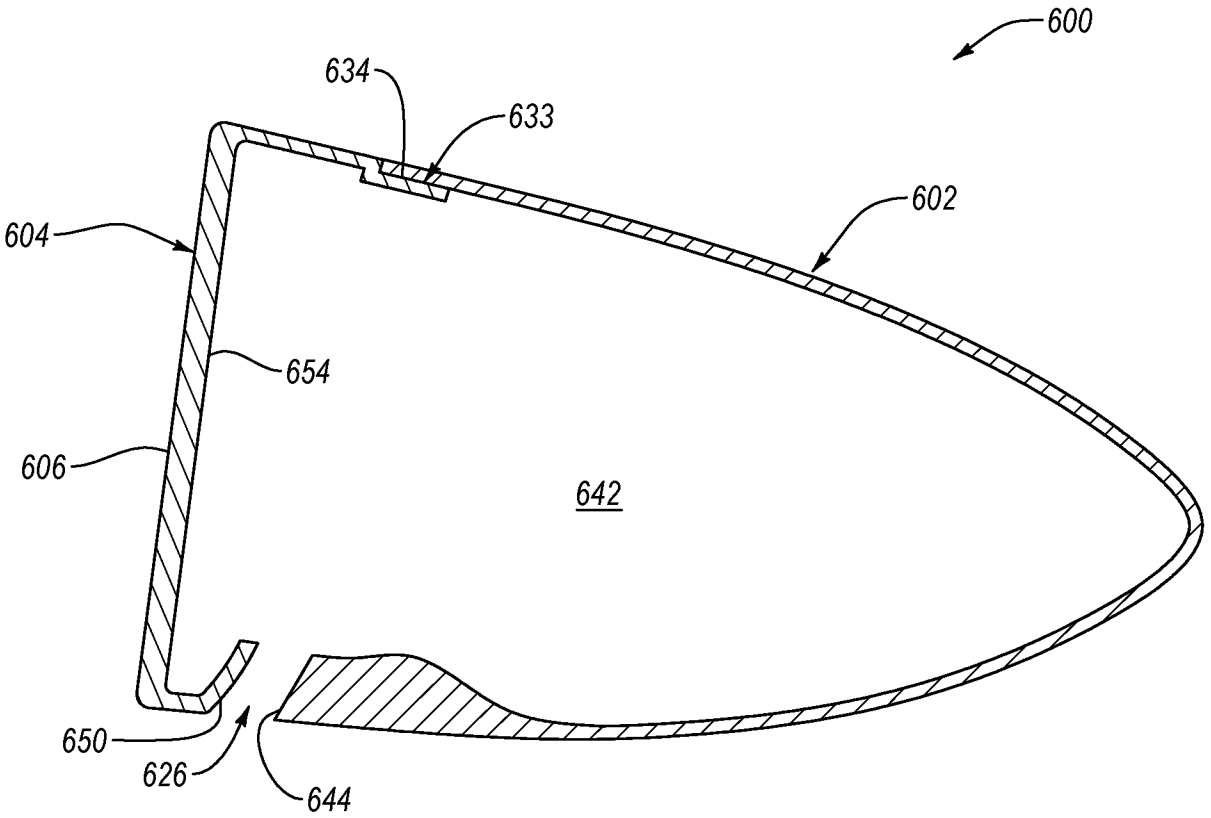
FIG. 21 is a cross-sectional side elevation view of the golf club head of FIG. 19, taken along a midplane of the golf club head, according to one or more examples of the present disclosure.

Referring now to FIGS. 20 and 21, another embodiment of a golf club head 600 is shown. The golf club head 600 is analogous to the golf club head 100, with like numbers referring to like features. More specifically, features of the golf club head 600 of FIGS. 20 and 21 that are analogous to features of the golf club head 100 have the same number, but in a different series (e.g., 600-series) format rather than the 100-series format of the golf club head 100. Therefore, unless otherwise noted, the description, including the structure, function, and advantages, of the features of the golf club head 100 presented above are applicable to the analogous features of the golf club head 600 of FIGS. 20 and 21.

In contrast to the golf club head 100, which is an iron-type golf club head, the golf club head 600 is a metal-wood-type golf club head or a driver-type golf club head. Accordingly, the body 602 and strike plate 604 of the golf club head 600 define an internal cavity 642 that is much larger than the internal cavity 142. For example, the internal cavity 642 facilitates a displaced volume of the golf club head 600 between about 120 $cm^2$ and 200 $cm^2$ in one implementation. However, in some implementations, the golf club head 60 can be configured to have a head volume between about 110 $cm^3$ and about 600 $cm^3$. In more particular implementations, the head volume may be between about 250 $cm^3$ and about 500 $cm^3$. In yet more specific implementations, the head volume may be between about 300 $cm^3$ and about 500 $cm^3$, between about 300 $cm^3$ and about 360 $cm^3$, between about 300 $cm^3$ and about 420 $cm^3$ or between about 420 $cm^3$ and about 500 $cm^3$. The golf club head 600 may have a volume between about 300 $cm^3$ and about 460 $cm^3$, and a total mass between about 145 g and about 245 g. Alternatively, the golf club head may have a volume between about 100 $cm^3$ and about 250 $cm^3$, and a total mass between about 145 g and about 260 g. In some implementations where the golf club head 600 is configured as a hybrid golf club head, the golf club head 600 may have a volume between about 60 $cm^3$ and about 150 $cm^3$, and a total mass between about 145 g and about 280 g.

The outer peripheral edge 633 of the strike plate 604 has a welded portion 634, welded to the body 602, and a non-welded portion 650 that is not welded to the body 602. Rather, the non-welded portion 650 faces and is spaced apart from a slot edge 644 of the body 602 to define a sole slot 626 of the golf club head 600. As shown in FIG. 20, the sole slot 626 can be filled with a non-metal filler material 628.

Although the illustrated embodiments show iron-type golf club heads and metal-wood-type golf club heads, it is recognized that the features, functions, and advantages associated with the iron-type golf club heads and metal-wood-type golf club heads also applies to hybrid-type golf club heads, driver-type golf club heads, and putter-type golf club heads.

As presented above, a ratio of the total length of the welded portion(s) 634 of the outer peripheral edge 633 to the total peripheral length of the strike plate 604 is less than one. In some implementations, the ratio of the total length of the welded portion(s) 634 of the outer peripheral edge 633 to the total peripheral length of the strike plate 604 is between about 0.40 and about 0.94. In yet certain implementations, the ratio of the total length of the welded portion(s) 634 of the outer peripheral edge 633 to the total peripheral length of the strike plate 604 is between about 0.45 and about 0.80. In one implementation, the ratio of the total length of the welded portion(s) 634 of the outer peripheral edge 633 to the total peripheral length of the strike plate 604 is about 0.625. According to further implementations, the ratio of the total length of the welded portion(s) 634 of the outer peripheral edge 633 to the total peripheral length of the strike plate 604 is between about 0.70 and about 0.75.

According to some embodiments of a golf club head with a sole slot, the length LSS of the sole slot is between about 50 mm and about 65 mm. In one implementation, the length LSS of the sole slot is between about 50 mm and about 60 mm. In another implementation, the length LSS of the sole slot is between about 55 mm and about 65 mm.

In some embodiments of a golf club head with a face slot at the heel of the golf club head, the length LFS of the face slot at the heel is between about 16 mm and about 19 mm. In some embodiments of a golf club head with a face slot at the toe of the golf club head, the length LFS of the face slot at the toe is between about 33 mm and about 40 mm. In certain implementations, the length LFS of the face slot at the toe is between about 33 mm and about 37 mm.

Figure 22:
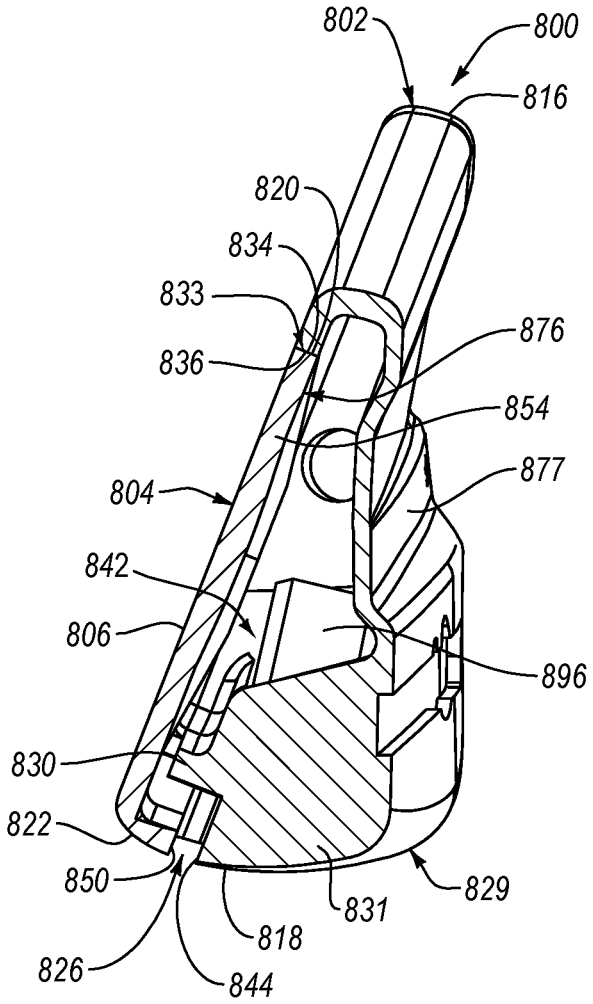
FIG. 22 is a cross-sectional side elevation view of an iron-type golf club head having a hollow cavity, according to one or more examples of the present disclosure.

Referring now to FIG. 22, one embodiment of a golf club head 800 is shown. The golf club head 800 of FIG. 22 is analogous to the golf club head 100 of FIGS. 1-11, with like numbers referring to like features. More specifically, features of the golf club head 800 of FIG. 22 that are analogous to features of the golf club head 100 have the same number, but in a different series (e.g., 800-series) format rather than the 100-series format of the golf club head 100. Therefore, unless otherwise noted, the description, including the structure, function, and advantages, of the features of the golf club head 100 presented above are applicable to the analogous features of the golf club head 800 of FIG. 22.

As described above and as shown in FIG. 22, one embodiment of a golf club head 800 includes a body 802 and a strike plate 804 which may be welded to the body 802. The body 802 has a toe portion, a heel portion, a top portion 816 (e.g., top-line portion for iron-type golf club heads and crown portion for driver-type, hybrid-type, and metal-wood-type golf club heads), and a sole portion 818 (e.g., bottom portion). The body 802 additionally includes a hosel extending from the heel portion. The hosel is configured to receive and engage with a shaft and grip of a golf club. The body may further include a slot edge 844 formed in the sole portion, and a sole slot 826 formed in the sole portion, as described above. The strike plate 804 includes at least a portion of a strike face 806 designed to impact a golf ball during a normal golf swing. In some implementations, the strike plate 804 includes an entirety of the strike face 806. Generally, the strike plate 804 is defined as any piece of the golf club head 800 that includes at least a portion of the strike face.

The body 802 is configured to receive the portions of an outer peripheral edge 833 of the strike plate 804, to be welded to the body 802 via the peripheral weld 820. More specifically, the body 802 includes a plate opening 876 defined between the toe portion 814, the heel portion 812, the top portion 816, and the sole portion 818 of the body 802. As described above, the outer peripheral edge 833 of the strike plate 804 may include at least one welded portion 834 and at least one non-welded portion 850.

The fit between the rim 836 of the plate interface 832 and the outer peripheral edge 833 of the strike plate 804 facilitates the butt welding together of the rim 836 of the body 802 and the outer peripheral edge 833 of the strike plate 804 with the peripheral weld 820. As described above, the strike plate 804 may include a sole wrap portion 822 that effectively wraps around the sole portion 818 of the body 802 to define a portion of the bottom of the golf club head 800. Additionally or alternatively, the sole wrap portion 822 may effectively wrap around the lower shelf 830 of the back portion 829.

As described above and as shown in FIG. 22, the back portion 829 may include a sole bar 831, which is located in a low, rearward portion of the golf club head 800. The sole bar 831 has a relatively large thickness in relation to the strike plate and other portions of the golf club head 800, thereby accounting for a significant portion of the mass of the golf club head 800, and thereby shifting a center of gravity (CG) of the golf club head 800 relatively lower and rearward. The back portion 829 also includes a lower shelf 830 and an upper shelf 840 protruding forwardly of the sole bar 831. The lower shelf 830 and the upper shelf 840 are spaced rearwardly of the strike plate 804 such that a gap is defined between each of the lower shelf 830 and the upper shelf 840 of the back portion 829. Defined between the lower shelf 830 and the upper shelf 840 is a portion of an internal cavity 842, which may extend upwards to the top portion 816. In the illustrated implementation, the internal cavity 842 is open to the sole slot 826. The plate opening 876 is partially open to the back of the body 802.

As opposed to the golf club head 100 of FIGS. 1-11, which illustrates a cavity-back or muscle-back type golf club head, the golf club head 800 of FIG. 22 is a hollow-cavity-type golf club head. More specifically, while the internal cavity 142 and the back surface 154 of the strike plate 104 of the golf club head 100 are not enclosed, but rather are open to a rear of the golf club head 100, the internal cavity 842 and the back surface 854 of the strike plate 804 of the golf club head 800 are enclosed or closed to a rear of the golf club head 800. The back portion 829 of the golf club head 800 further includes a rear wall 877 that encloses a rearward side of the internal cavity 842. The golf club head 800 having a hollow internal cavity 842 provides several advantages, such as an increased forgiveness for off-center hits on the strike face 806 of the strike plate 804. In some embodiments, the volume of the golf club head 800 is between about 10 $cm^3$ and about 120 $cm^3$. For example, in some embodiments, the golf club head 800 has a volume between about 20 $cm^3$ and about 110 $cm^3$, such as between about 30 $cm^3$ and about 100 $cm^3$, such as between about 40 $cm^3$ and about 90 $cm^3$, such as between about 50 $cm^3$ and about 80 $cm^3$, and such as between about 60 $cm^3$ and about 80 $cm^3$. In addition, in some embodiments, the golf club head 800 has an overall depth that is between about 15 mm and about 100 mm. For example, in some embodiments, the golf club head 800 has an overall depth between about 20 mm and about 90 mm, such as between about 30 mm and about 80 mm and such as between about 40 mm and about 70 mm.

Other examples of cavity-back, muscle-back, and hollow-cavity iron-type golf club heads are described in U.S. patent application Ser. No. 14/981,330, filed Dec. 28, 2015, which is incorporated herein by reference.

In some implementations, the golf club head 800 includes weighted elements, such as a tungsten plug 896, located at least partially within the internal cavity 842 in some implementations. Additionally, the body of the golf club heads of the present disclosure can include various features such as weighting elements, cartridges, and/or inserts or applied bodies as used for CG placement, vibration control or damping, or acoustic control or damping. For example, U.S. Pat. No. 6,811,496, incorporated herein by reference in its entirety, discloses the attachment of mass altering pins or cartridge weighting elements.

Figure 24:
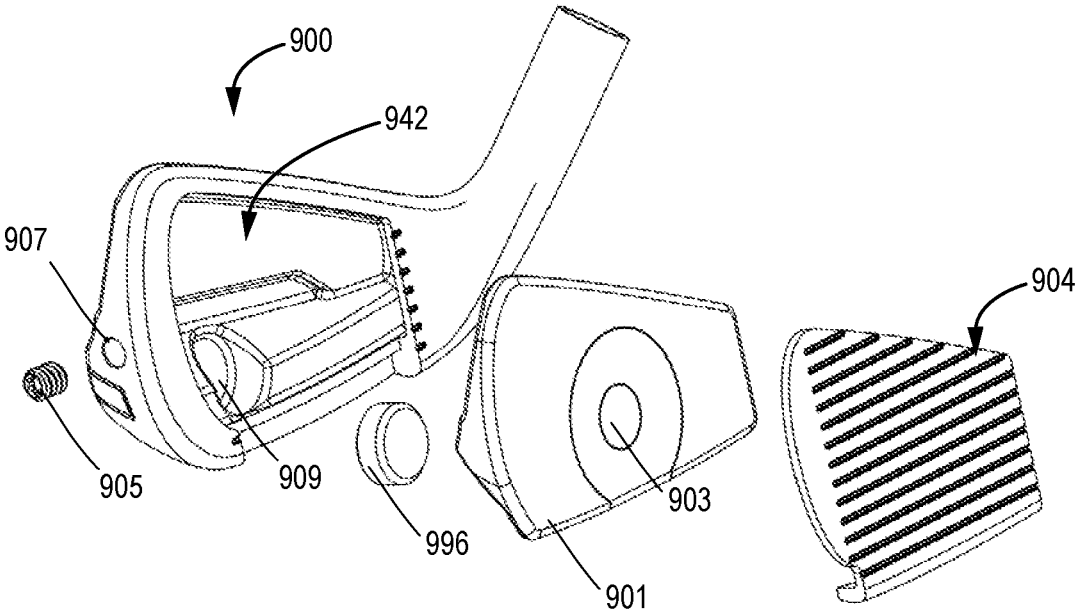
FIG. 24 is an exploded perspective view from a golf club head, according to one or more examples of the present disclosure.

In one embodiment, the golf club of FIG. 24 has an internal cavity 942 that is partially or entirely filled with a filler material 901.

In some implementations, the filler material 901 is made from a non-metal, such as a thermoplastic material, thermoset material, and the like, in some implementations. In other implementations, the internal cavity 842 is not filled with a filler material 901, but rather maintains an open, vacant, cavity within the club head.

According to one embodiments, the filler material 901 is initially a viscous material that is injected or otherwise inserted into the club head through an injection port 907 located on the toe portion of the club head. The injection port 907 can be located anywhere on the club head 900 including the topline, sole, heel, or toe. Examples of materials that may be suitable for use as a filler material 901 to be placed into a club head include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd. In still other embodiments, the filler 901 material may be placed into the club head 900 and sealed in place with a plug 905, or resilient cap or other structure formed of a metal, metal alloy, metallic, composite, hard plastic, resilient elastomeric, or other suitable material. In one embodiment, the plug 905 is a metallic plug that can be made from steel, aluminum, titanium, or a metallic alloy. In one embodiment, the plug 905 is an anodized aluminum plug that is colored a red, green, blue, gray, white, orange, purple, black, clear, yellow, or metallic color. In one embodiment, the plug 905 is a different or contrasting color from the majority color located on the club head body 900.

In some embodiments, the filler material includes a slight recess or depression 903 that accommodates the variable face thickness of the striking plate 904. In other words, the recess or depression 903 located in the filler material 901 mates or is keyed with a thickened portion of the striking plate 904. In one embodiment, the thickened portion of the striking plate 904 occurs at the center of the striking plate 904.

In one embodiment, the golf club head 900 includes a recess 909 that allows the weight 996 to be located. Once the weight 996 is positioned within the recess 909 and the strike plate 904 has been attached, the filler material 901 is injected through the port 907 and sealed with the plug 905.

In one embodiment, the filler material 901 has a minor impact on the coefficient of restitution (herein "COR") as measured according to the United States Golf Association (USGA) rules set forth in the Procedure for Measuring the Velocity Ratio of a Club Head for Conformance to Rule 4-1e, Appendix II Revision 2 Feb. 8, 1999, herein incorporated by reference in its entirety.

Table 1 below provides examples of the COR change relative to a calibration plate of multiple club heads of the construction shown in FIG. 24 in both a filled and unfilled state. The calibration plate dimensions and weight are described in section 4.0 of the Procedure for Measuring the Velocity Ratio of a Club Head for Conformance to Rule 4-1e.

Due to the slight variability between different calibration plates, the values described below are described in terms of a change in COR relative to a calibration plate base value. For example, if a calibration plate has a 0.831 COR value, Example 1 for an un-filled head has a COR value of −0.019 less than 0.831 which would give Example 1 (Unfilled) a COR value of 0.812. The change in COR for a given head relative to a calibration plate is accurate and highly repeatable.

TABLE 1

COR Values Relative to a Calibration Plate

| Example No. | Unfilled COR Relative to Calibration Plate | Filled COR Relative to Calibration Plate | COR Change Between Filled and Unfilled |
|---|---|---|---|
| 1 | −0.019 | −0.022 | −0.003 |
| 2 | −0.003 | −0.005 | −0.002 |
| 3 | −0.006 | −0.010 | −0.004 |
| 4 | −0.006 | −0.017 | −0.011 |
| 5 | −0.026 | −0.028 | −0.002 |
| 6 | −0.007 | −0.017 | −0.01 |
| 7 | −0.013 | −0.019 | −0.006 |
| 8 | −0.007 | −0.007 | 0 |
| 9 | −0.012 | −0.014 | −0.002 |
| 10 | −0.020 | −0.022 | −0.002 |
| Average | −0.0119 | −0.022 | −0.002 |

Table 1 illustrates that before the filler material 901 is introduced into the cavity 942 of golf club head 900, an Unfilled COR drop off relative to the calibration plate (or first COR drop off value) is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005.

In one embodiment, the average COR drop off or loss relative to the calibration plate for a plurality of Unfilled COR golf club head within a set of irons is between 0 and −0.05, between 0 and −0.03, between −0.00001 and −0.03, between −0.00001 and −0.025, between −0.00001 and −0.02, between −0.00001 and −0.015, or between −0.00001 and −0.01.

Table 1 further illustrates that after the filler material 901 is introduced into the cavity 942 of golf club head 900, a Filled COR drop off relative to the calibration plate (or second COR drop off value) is more than the Unfilled COR drop off relative to the calibration plate. In other words, the addition of the filler material 901 in the Filled COR golf club heads slows the ball speed (Vout—Velocity Out) after rebounding from the face by a small amount relative to the rebounding ball velocity of the Unfilled COR heads.

In some embodiments shown in Table 1, the COR drop off or loss relative to the calibration plate for a Filled COR golf club head is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005.

In one embodiment, the average COR drop off or loss relative to the calibration plate for a plurality of Filled COR golf club head within a set of irons is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005.

However, the amount of COR loss or drop off for a Filled COR head is minimized when compared to other constructions and filler materials. The last column of Table 1 illustrates a COR change between the Unfilled and Filled golf club heads which are calculated by subtracting the Unfilled COR from the Filled COR table columns. The change in COR (COR change value) between the Filled and Unfilled club heads is between 0 and −0.1, between 0 and −0.05, between 0 and −0.04, between 0 and −0.03, between 0 and −0.025, between 0 and −0.02, between 0 and −0.015, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002. Remarkably, one club head was able to achieve a change in COR of zero between a filled and unfilled golf club head. In other words, no change in COR between the Filled and Unfilled club head state. In some embodiments, the COR change value is greater than −0.1, greater than −0.05, greater than −0.04, greater than −0.03, greater than −0.02, greater than −0.01, greater than −0.009, greater than −0.008, greater than −0.007, greater than −0.006, greater than −0.005, greater than −0.004, or greater than −0.003.

In some embodiments, at least one, two, three or four iron golf clubs out of an iron golf club set has a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

In yet other embodiments, at least one pair or two pair of iron golf clubs in the set have a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

In other embodiments, an average of a plurality of iron golf clubs in the set has a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

Figure 25:
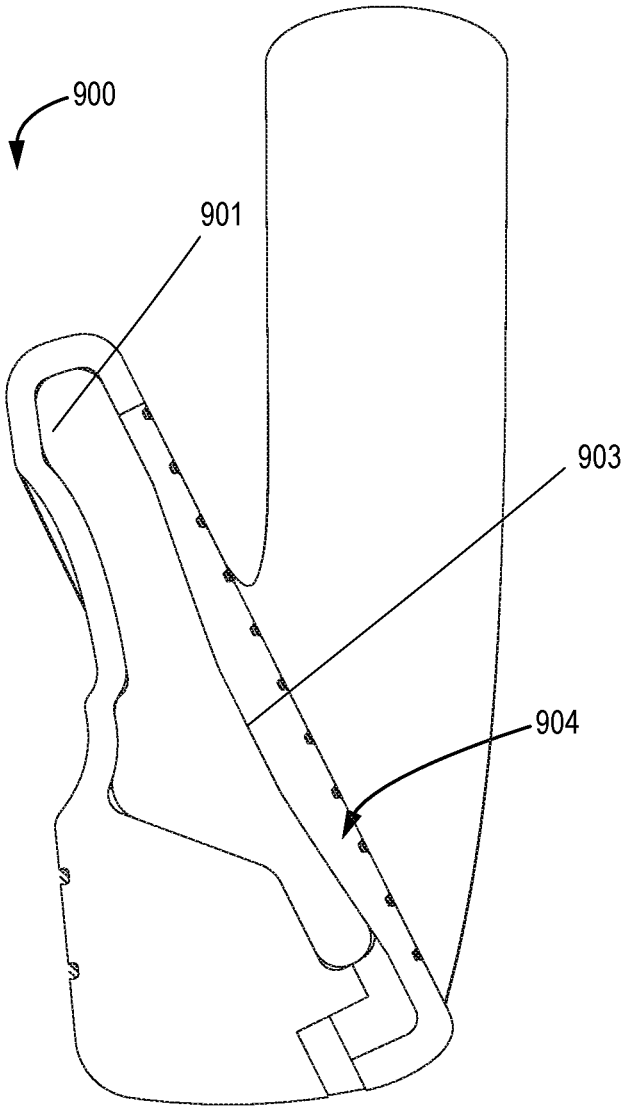
FIG. 25 is a cross-sectional view through the center face of the golf club head shown in FIG. 24, according to one or more examples of the present disclosure.

FIG. 25 illustrates a cross-sectional view through the center face of the golf club head shown in FIG. 24. The filler material 901 fills the cavity 942 located above the sole slot 926. The recess or depression 903 engages with the thickened portion of the striking plate 904.

In some embodiments, the filler material 901 is a two part polyurethane foam that is a thermoset and is flexible after it is cured. In one embodiment, the two part polyurethane foam is any methylene diphenyl diisocyanate (a class of polyurethane prepolymer) or silicone based flexible or rigid polyurethane foam.

Figure 23:
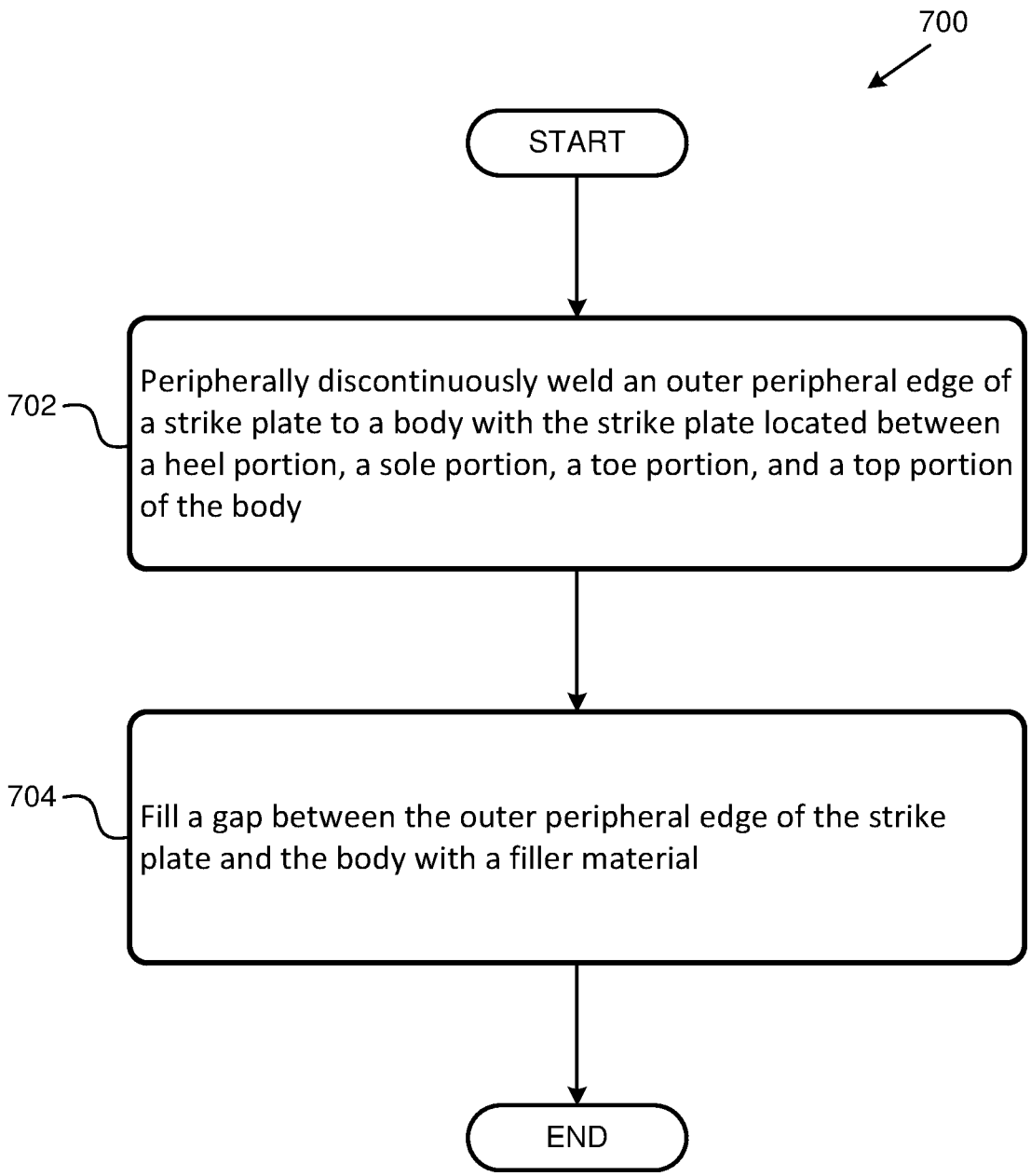
FIG. 23 is a schematic flow chart of a method of making a golf club head, according to one or more examples of the present disclosure.

Referring now to FIG. 23, referring to one embodiment, a method 700 of making a golf club head, such as the golf club heads described herein, includes peripherally discontinuously welding an outer peripheral edge of a strike plate to a body with the strike plate located between a heel portion, a sole portion, a toe portion, and a top portion of the body at 702. Additionally, the method 700 includes filling a gap between the outer peripheral edge of the strike plate and the body with a filler material at 704.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some embodiments, can be defined to mean within +/−5% of a given value.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A hollow body iron-type golf club head, comprising:

a body, comprising a heel portion, a first part of a sole portion, a toe portion, a top portion, a rear wall, and a hosel of the golf club head;

a strike plate welded to the body, wherein:

the strike plate comprises a strike face of the golf club head, a second part of the sole portion of the golf club head, and a majority of a face-to-sole portion transition region between the face and the sole portion;

the strike plate, the heel portion, the sole portion, the toe portion, the top portion, and the rear wall enclose an internal cavity of the golf club head;

the second part of the sole portion has an internal surface that defines a portion of the internal cavity;

the strike plate has a central portion and a peripheral portion surrounding the central portion, wherein a thickness of the central portion is greater than a thickness of the peripheral portion; and the first part of the sole portion comprises a recess formed in an internal surface of the first part of the sole portion;

a filler material within the internal cavity;

a tungsten weight located within the recess of the first part of the sole portion;

a first COR drop off value when the internal cavity is unfilled;

a second COR drop off value when the internal cavity is at least partially filled with the filler material; and a COR change value being a difference between the second COR drop off value and the first COR drop off value;

wherein:

the COR change value is between 0 and −0.01;

the filler material is only a polyurethane based foam;

the body further comprises a threaded toe port formed in the toe portion of the golf club head, wherein the internal cavity is configured to receive the filler material through the threaded toe port; and the golf club head further comprises a threaded plug that is threadably engaged with the threaded toe port to plug the threaded toe port.

2. The golf club head according to claim 1, wherein the polyurethane based foam is a two part polyurethane based foam.

3. The golf club head according to claim 1, wherein the filler material is flexible after it is cured.

4. The golf club head according to claim 3, wherein the filler material is a thermoset.

5. The golf club head according to claim 1, wherein a COR of the golf club head is no less than 0.814.

6. The golf club head according to claim 5, wherein the COR change value is between 0 and −0.006.

7. The golf club head according to claim 1, wherein a COR of the golf club head is greater than 0.812.

8. The golf club head according to claim 7, wherein the COR change value is between 0 and −0.004.

9. The golf club head according to claim 1, wherein a COR of the golf club head is no less than 0.821.

10. The golf club head according to claim 1, wherein:

the rear wall is coupled to and extends rearwardly from the first part of the sole portion;

the rear wall comprises a sole bar; and the filler material extends overtop the sole bar.

11. The golf club head according to claim 1, wherein:

the rear wall comprises a sole bar protruding from the first part of the sole portion into the internal cavity, wherein the sole bar is located in a low and rearward portion of the golf club head and has a relatively large thickness in relation to the strike plate;

the rear wall further comprises a forward sole bar protrusion protruding from the sole bar forward towards the strike plate;

the second part of the sole portion wraps underneath the forward sole bar protrusion protruding from the sole bar;

the filler material contacts an underside surface of the forward sole bar protrusion and contacts an interior surface of the second part of the sole portion;

a thickness of the strike plate varies and a thickness of the second part of the sole portion is less than the thickness of the central portion of strike plate;

at least a portion of the second part of the sole portion is welded along the first part of the sole portion; and at least one of the strike plate and the body are formed of a stainless steel.

12. The golf club head according to claim 11, wherein the tungsten weight has a density greater than a density of the body.

13. The golf club head according to claim 1, wherein the polyurethane based foam is a methylene diphenyl diisocyanate based foam.

14. The golf club head according to claim 1, wherein part of the strike plate extends further toward than the second part of the sole portion.

15. The golf club head according to claim 1, wherein the recess comprises at least a rear wall, a bottom wall, and two opposing side walls, and wherein the tungsten weight is at least partially surrounded by the rear wall, bottom wall, and the two opposing side walls of the recess.

16. The golf club head according to claim 1, wherein the tungsten weight is at least partially surrounded by the filler material.

17. The golf club head according to claim 1, wherein a majority of the tungsten weight is below the threaded toe port when the golf club head is in proper address position.

18. The golf club head according to claim 1, wherein the body is cast and the strike plate is forged.

19. A hollow body iron-type golf club head, comprising:

a body, comprising a heel portion, a first part of a sole portion, a toe portion, a top portion, a rear wall, and a hosel of the golf club head;

a strike plate welded to the body, wherein:

the strike plate comprises a strike face of the golf club head, a second part of the sole portion of the golf club head, and a majority of a face-to-sole portion transition region between the face and the sole portion;

the strike plate, the heel portion, the sole portion, the toe portion, the top portion, and the rear wall enclose an internal cavity of the golf club head;

the second part of the sole portion has an internal surface that defines a portion of the internal cavity;

the strike plate has a central portion and a peripheral portion surrounding the central portion, wherein a thickness of the central portion is greater than a thickness of the peripheral portion; and the first part of the sole portion comprises a recess formed in an internal surface of the first part of the sole portion;

a filler material within the internal cavity;

a tungsten weight located within the recess of the first part of the sole portion;

a first COR drop off value when the internal cavity is unfilled;

a second COR drop off value when the internal cavity is at least partially filled with the filler material; and a COR change value being a difference between the second COR drop off value and the first COR drop off value;

wherein:

the filler material is only a polyurethane based foam;

the COR change value is greater than −0.002;

a COR of the golf club head is no less than 0.826;

the body further comprises a threaded toe port formed in the toe portion of the golf club head, wherein the internal cavity is configured to receive the filler material through the threaded toe port; and the golf club head further comprises a threaded plug that is threadably engaged with the threaded toe port to plug the threaded toe port.

20. The golf club head according to claim 19, wherein the strike plate is made of a first material and the body is made of a second material that is different than the first material.

21. The golf club head according to claim 19, wherein:

the rear wall comprises a sole bar;

the filler material extends overtop the sole bar; and the threaded toe port is located in the toe portion of the club between the top portion, at a location where the top portion is coupled with the toe portion, and the second part of the sole portion, at a location where the second part of the sole portion is coupled with the toe portion.

22. The golf club head according to claim 19, wherein:

the rear wall comprises a sole bar protruding from the first part of the sole portion into the internal cavity, wherein the sole bar is located in a low and rearward portion of the golf club head and has a relatively large thickness in relation to the strike plate;

the rear wall further comprises a forward sole bar protrusion protruding from the sole bar forward towards the strike plate;

the second part of the sole portion wraps underneath the forward sole bar protrusion protruding from the sole bar;

the filler material contacts an underside surface of the forward sole bar protrusion and contacts an interior surface of the second part of the sole portion;

a thickness of the strike plate varies and a thickness of the second part of the sole portion is less than the thickness of the central portion of strike plate;

at least a portion of the second part of the sole portion is welded along the first part of the sole portion; and at least one of the strike plate and the body are formed of a stainless steel.

23. The golf club head according to claim 22, wherein the tungsten weight has a density greater than a density of the body.

24. The golf club head according to claim 19, wherein the polyurethane based foam is a methylene diphenyl diisocyanate based foam.

25. A hollow body iron-type golf club head, comprising:

a body, comprising a heel portion, a first part of a sole portion, a toe portion, a top portion, a rear wall, and a hosel of the golf club head;

a strike plate welded to the body, wherein:

the strike plate comprises a strike face of the golf club head, a second part of the sole portion of the golf club head, and a majority of a face-to-sole portion transition region between the face and the sole portion;

the strike plate, the heel portion, the sole portion, the toe portion, the top portion, and the rear wall enclose an internal cavity of the golf club head;

the second part of the sole portion has an internal surface that defines a portion of the internal cavity;

the strike plate has a central portion and a peripheral portion surrounding the central portion, wherein a thickness of the central portion is greater than a thickness of the peripheral portion; and the first part of the sole portion comprises a recess formed in an internal surface of the first part of the sole portion;

a filler material within the internal cavity;

a tungsten weight located within the recess of the first part of the sole portion;

a first COR drop off value when the internal cavity is unfilled;

a second COR drop off value when the internal cavity is at least partially filled with the filler material; and a COR change value being a difference between the second COR drop off value and the first COR drop off value;

wherein:

the COR change value is between 0 and −0.01;

the filler material is only a polyurethane based foam;

wherein the polyurethane based foam is a two part polyurethane based foam;

the body further comprises a threaded toe port formed in the toe portion of the golf club head, wherein the internal cavity is configured to receive the filler material through the threaded toe port; and the golf club head further comprises a threaded plug that is threadably engaged with the threaded toe port to plug the threaded toe port;

the rear wall comprises a sole bar protruding from the first part of the sole portion into the internal cavity, wherein the sole bar is located in a low and rearward portion of the golf club head and has a relatively large thickness in relation to the strike plate;

a thickness of the second part of the sole portion is less than the thickness of the central portion of strike plate;

at least a portion of the second part of the sole portion is welded along the first part of the sole portion; and the filler material extends overtop the sole bar.

* * * * *